US008043777B2

(12) United States Patent
Kami et al.

(10) Patent No.: US 8,043,777 B2
(45) Date of Patent: Oct. 25, 2011

(54) ELECTROPHOTOGRAPHIC PHOTOCONDUCTOR, PROCESS CARTRIDGE, AND IMAGE FORMING APPARATUS

(75) Inventors: Hidetoshi Kami, Numazu (JP); Tetsuro Suzuki, Fuji (JP); Hiroshi Tamura, Susono (JP); Yukio Fujiwara, Numazu (JP); Hiroshi Ikuno, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 544 days.

(21) Appl. No.: 12/206,946

(22) Filed: Sep. 9, 2008

(65) Prior Publication Data

US 2009/0067891 A1 Mar. 12, 2009

(30) Foreign Application Priority Data

Sep. 12, 2007 (JP) ..... 2007-237001

(51) Int. Cl.
*G03G 5/147* (2006.01)

(52) U.S. Cl. ..... 430/66; 430/96

(58) Field of Classification Search ..... 430/66, 430/96

See application file for complete search history.

(56) References Cited

U.S. PATENT DOCUMENTS

| | | | | |
|---|---|---|---|---|
| 5,871,876 | A | 2/1999 | Ikuno et al. | |
| 6,030,733 | A | 2/2000 | Kami et al. | |
| 6,151,468 | A | 11/2000 | Kami et al. | |
| 6,265,122 | B1 * | 7/2001 | Itami et al. | 430/58.2 |
| 6,861,188 | B2 | 3/2005 | Ikegami et al. | |
| 6,936,388 | B2 | 8/2005 | Suzuki et al. | |
| 7,018,755 | B2 | 3/2006 | Ikegami et al. | |
| 7,160,658 | B2 | 1/2007 | Suzuki et al. | |
| 7,267,916 | B2 | 9/2007 | Sugino et al. | |
| 7,314,693 | B2 | 1/2008 | Ikegami et al. | |
| 7,315,722 | B2 | 1/2008 | Kitajima et al. | |
| 7,341,814 | B2 | 3/2008 | Kami et al. | |
| 7,381,511 | B2 | 6/2008 | Ikegami et al. | |
| 7,386,256 | B2 | 6/2008 | Kondo et al. | |
| 2004/0253527 | A1 * | 12/2004 | Suzuki et al. | 430/66 |
| 2005/0287452 | A1 | 12/2005 | Tamura et al. | |
| 2007/0031746 | A1 | 2/2007 | Toshine et al. | |
| 2007/0117033 | A1 * | 5/2007 | Sugino et al. | 430/58.7 |
| 2007/0196749 | A1 | 8/2007 | Inaba et al. | |
| 2007/0196750 | A1 | 8/2007 | Fujiwara et al. | |
| 2007/0212626 | A1 | 9/2007 | Toshine et al. | |
| 2008/0085459 | A1 | 4/2008 | Kami et al. | |
| 2008/0138725 | A1 | 6/2008 | Fujiwara et al. | |
| 2008/0153021 | A1 | 6/2008 | Ikuno et al. | |
| 2008/0199217 | A1 | 8/2008 | Iwamoto et al. | |

(Continued)

FOREIGN PATENT DOCUMENTS

JP 7-325409 12/1995

(Continued)

OTHER PUBLICATIONS

Tamura, Hiroyuki, et al., "Polycarbonate Resin for Long Life OPC", *Japan Hardcopy '97 Fall Meeting*, pp. 25-28, 1997.

*Primary Examiner* — Hoa Le
(74) *Attorney, Agent, or Firm* — Cooper & Dunham LLP

(57) ABSTRACT

The present invention provides an electrophotographic photoconductor including, an uppermost crosslinked surface layer including a cured product of a crosslinked surface layer composition containing a tri- or more functional radical-polymerizable monomer having no charge transportable structure, organosilica sol, an isocyanate group-containing radical-polymerizable monomer, and a curable charge transport material.

9 Claims, 7 Drawing Sheets

U.S. PATENT DOCUMENTS

2008/0227008 A1 9/2008 Kami et al.

FOREIGN PATENT DOCUMENTS

| | | |
|---|---|---|
| JP | 10-195170 | 7/1998 |
| JP | 10-221874 | 8/1998 |
| JP | 2000-66424 | 3/2000 |
| JP | 2000-171990 | 6/2000 |
| JP | 2002-258499 | 9/2002 |
| JP | 2005-77947 | 3/2005 |
| JP | 2006-10963 | 1/2006 |
| JP | 2006-259030 | 9/2006 |

* cited by examiner

ELECTROPHOTOGRAPHIC PHOTOCONDUCTOR, PROCESS CARTRIDGE, AND IMAGE FORMING APPARATUS

BACKGROUND OF THE INVENTION

1. Field of the Invention

The present invention relates to an electrophotographic photoconductor used in image formation of electrostatic copying processes in, for example, copiers, facsimiles and printers; and to a process cartridge and an image forming apparatus which contain the electrophotographic photoconductor.

2. Description of the Related Art

Inorganic photoconductors made of selenium, zinc oxide, cadmium sulfide, etc., were mainly applied to electrophotographic image forming apparatus such as copiers and laser printers. Organic photoconductors (OPCs), currently, account for nearly 100% of the total production of electrophotographic photoconductors, since they are more advantageous than inorganic photoconductors in reducing production cost, increasing high design flexibility, and giving low environment load. Manufacturers are required to more deeply consider global environmental protection, and to manufacture organic photoconductors (OPCs) as one of mechanical parts instead of a disposable product.

In an attempt to manufacture organic photoconductors (OPCs) having higher durability, there have been taken the following measures: use of a different type of binder resin (see "Hiroyuki Tamura, Saeko Takahashi, Hironobu Morishita, Hideharu Sakamoto, Haruo Shikuma, Japan Hardcopy '97 Fall Meeting, 25-28, 1997"), use of a high-molecular-weight charge transport material (see Japanese Patent Application Laid-Open (JP-A) No. 07-325409), coating of a curable protective layer containing high-hardness fillers (see JP-A No. 2002-258499), formation of a crosslinked resin layer on the surface of a photoconductor (see JP-A No. 2000-66424), and formation of a sol-gel curable film on the surface of a photoconductor (see JP-A No. 2000-171990).

Among the aforementioned measures, formation of a crosslinked resin layer (crosslinked surface layer) can be considered a reasonable solution. This is because the crosslinked layer has a plurality of chemical bonds and, even when stress is applied to cleave some chemical bonds, the layer is not worn in short time.

Organic photoconductors having very high wear resistance must be resistant to scratch formation. This is because, when the surface of such organic photoconductors is scratched, discharge hazard during electrophotographic processes occurs intensively in the scratched portions, resulting in deterioration of these portions. In addition, when the scratched portions (grooves) are embedded with a toner particles-containing developer or paper dust, image failures such as background smear and image blur tend to locally occur. In accordance with improvement in ablation resistance of the photoconductor surface, the formed scratches are difficult to disappear even as time passes (as if they are engraved). Thus, the scratches shorten the service life of the photoconductors.

The recent full-color electrophotographic image forming apparatus generally use polymerization toner, since it provides high-quality images and has high environmental stability. As polymerization toner particles become more spherical, the formed images have an increased sharpness, but toner particles are easier to run through the gap between the photoconductor and the cleaning blade for recovering them. When the cleaning blade is brought into contact with the photoconductor at higher contact pressure, toner particles are prevented from running through the gap therebetween. Meanwhile, the cleaning blade is chipped through acceleration of wear of the contact portion. This results in streaking the photoconductor surface (cleaning failure), and the photoconductor cannot maintain its wear resistance over a long period of time.

The above-described crosslinked surface layer is particularly preferably a cured acrylic film, since it has high wear resistance. However, when used in image forming apparatus using polymerization toner, the cured acrylic film give great damage to the cleaning blade. As a result, the service life of the photoconductor depends on that of the cleaning blade, which is problematic.

JP-A No. 2006-010963 discloses that an electrophotographic photoconductor is provided with a crosslinked surface layer by performing, in combination, thermal curing and photo curing. As described in paragraph [0025] of this literature, use of photopolymerization and thermopolymerization initiators provides a crosslinked surface layer having more uniform cure degree. This crosslinked surface layer does not generate wrinkles and cracks. Also, in this layer, oxidation gas is prevented from adsorbing to unreacted carbon-carbon double bonds.

JP-A No. 2005-077947 discloses that a crosslinked film is formed from a composition containing SUPER BECKAMINE G-821-60 (melamine; product of Dainippon Ink and Chemicals Inc.), Sumidule HT (adduct of HDI isocyanate and trimethylolpropane; product of Sumitomo Bayer Urethane Company Ltd.), and a radical-polymerizable monomer. The crosslinked film exhibits improved resistance to crack formation and exfoliation.

The mechanical strength of the crosslinked surface layer depends on the total chemical bond energy and the crosslink density, and these factors vary with the type of materials used. Thus, demand has arisen for further improvement and development of the crosslinked surface layer.

BRIEF SUMMARY OF THE INVENTION

An object of the present invention is to provide an electrophotographic photoconductor which has remarkably excellent wear resistance, which can provide high-quality color images, and which can prevent a cleaning blade from chipping; and a process cartridge and an image forming apparatus which contain the electrophotographic photoconductor.

The present invention provides the following in order to solve the above-described problems.

<1> An electrophotographic photoconductor including, an uppermost crosslinked surface layer including a cured product of a crosslinked surface layer composition containing a tri- or more functional radical-polymerizable monomer having no charge transportable structure, organosilica sol, an isocyanate group-containing radical-polymerizable monomer, and a curable charge transport material.

<2> The electrophotographic photoconductor according to <1> above, wherein the tri- or more functional radical-polymerizable monomer having no charge transportable structure includes trimethylolpropane triacrylate.

<3> The electrophotographic photoconductor according to any one of <1> and <2> above, wherein the isocyanate group-containing radical-polymerizable monomer is any one of 2-methacryloyloxyethyl isocyanate, 2-acryloyloxyethyl isocyanate and 1,1-bis(acryloyloxymethyl)ethylisocyanate.

<4> The electrophotographic photoconductor according to any one of <1> to <3> above, wherein the curable charge transport material content of the crosslinked surface layer composition is 5% by mass to 60% by mass on a solid basis, and the curable charge transport material is a compound represented by the following general formula (1):

General Formula (1)

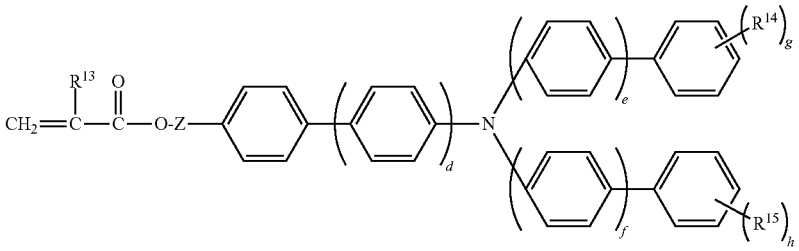

wherein $R^{13}$ represents a hydrogen atom or a methyl group; $R^{14}$ and $R^{15}$, which may be identical or different, each represent an alkyl group having 1 to 6 carbon atoms; g or h is an integer of 0 to 3; d, e or f is an integer of 0 or 1; and Z represents a single bond, a methylene group, an ethylene group or any one of groups represented by the following structural formulas:

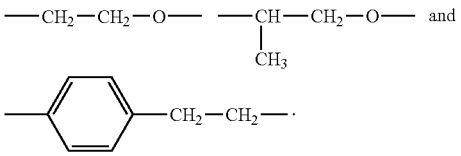

<5> The electrophotographic photoconductor according to any one of <1> to <4> above, wherein the crosslinked surface layer composition contains a reactive silicone compound having a dimethylsiloxane structure as a repeating unit and having a radical-polymerizable functional group.

<6> The electrophotographic photoconductor according to any one of <1> to <5> above, wherein the electrophotographic photoconductor includes, in sequence, a support, a charge generation layer, a charge transport layer and a crosslinked surface layer.

<7> A process cartridge including, the electrophotographic photoconductor according to any one of <1> to <6> above, a developing unit configured to form a visible image by developing with toner a latent electrostatic image formed on the electrophotographic photoconductor, and a cleaning unit configured to remove residual toner particles on a surface of the electrophotographic photoconductor.

<8> An image forming apparatus including, the electrophotographic photoconductor according to any one of <1> to <6> above, a latent electrostatic image forming unit configured to form a latent electrostatic image on the electrophotographic photoconductor, a developing unit configured to form a visible image by developing the latent electrostatic image with toner, a transferring unit configured to transfer the visible image onto a recording medium, and a cleaning unit configured to remove residual toner particles on a surface of the electrophotographic photoconductor.

<9> The image forming apparatus according to <8> above, wherein the image forming apparatus is a tandem image forming apparatus including image forming components including the electrophotographic photoconductor, a charging unit, a developing unit, a transferring unit and a cleaning unit, wherein polymerization toner is used in the developing unit.

<10> An image forming process including, forming a latent electrostatic image on the electrophotographic photoconductor according to any one of <1> to <6> above, forming a visible image by developing the latent electrostatic image with toner, transferring the visible image onto a recording medium, and removing residual toner particles on a surface of the electrophotographic photoconductor.

Acrylic resins formed mainly of trimethylolpropane triacrylate (TMPTA), which serves as a tri- or more functional radical-polymerizable monomer having no charge transportable structure, are known to provide a cured product having high surface hardness. In order for the cured product to have higher surface hardness, organosilica sol is advantageously incorporated into acrylic resin. However, when a composition containing acrylic resin and organosilica sol is used, the formed crosslinked surface layer often has a very broad surface hardness distribution, since cured products of organosilica are localized in acrylic resin and give adverse effects on curing thereof.

When electrophotographic photoconductors containing such a crosslinked surface layer are used to print out about 100,000 sheets, cleaning failure may be caused; i.e., the electrophotographic photoconductors may be streaked. Wear and chip of the cleaning blade, which occur where the blade is rubbed against an electrophotographic photoconductor, are thought to adversely affect the surface roughness and hardness of the photoconductor. The streaky photoconductor surface due to cleaning failure is attributable to the broad hardness distribution of the photoconductor surface.

When an isocyanate compound having a radical-polymerizable functional group is incorporated into a composition for a cured acrylic film to be formed on the photoconductor surface, the cured acrylic film can contain urea bonds formed between isocyanate groups. Also, when a polyol compound and an active hydrogen compound are incorporated into the composition, the cured acrylic film can contain urethane bonds.

The present inventors have found that chipping of a cleaning blade can be remarkably reduced by incorporating an isocyanate compound into a cured acrylic film-composition to chemically bind thermosetting organosilica sol. This is because, conceivably, the isocyanate compound allows the photoconductor surface to have a sharp hardness distribution.

Examples of such an isocyanate group-containing radical-polymerizable monomer include 2-methacryloyloxyethyl isocyanate, 2-acryloyloxyethyl isocyanate, and 1,1-bis(acryloyloxymethyl)ethylisocyanate. These compounds are preferably used for fabricating photoconductors with a sharp surface hardness distribution. Also, a crosslinked surface layer-composition containing these compounds does not exhibit poor curing performance. Furthermore, a crosslinked surface layer formed of the composition does not exhibit deteriorated electrostatic characteristics.

When a curable charge transport material is incorporated into the crosslinked surface layer, generation of residual images can be prevented and electric potential at light-exposed areas can be reduced. The curable charge transport material is preferably those having a crosslinkable substituent in order to impart high mechanical strength to the layer. Most preferred are radical-polymerizable functional group-containing curable charge transport materials represented by general formula (1).

During film formation using a composition containing a radical-polymerizable compound, the coated film emits intense radiation heat. Excessive energy emitted is thought to give damage to the photoconductive layer provided thereunder. Thus, in a film-forming step, attention must be paid for the photoconductive layer to avoid receiving damage, by water-cooling the photoconductor support or by performing air cooling and intermittent light exposure.

In the electrophotographic photoconductor of the present invention, radiation heat generated in forming the crosslinked surface layer by light exposure is consumed in crosslinking reaction of isocyanate moieties to give reduced damage to the photoconductive layer. Needless to say, the film-forming step is preferably performed so as to attain the above advantageous effects, which can greatly contribute to increase in production yield of electrophotographic photoconductors. In addition, the produced electrophotographic photoconductors have remarkably excellent wear resistance, can provide high-quality, full-color images, and can prevent a cleaning blade from chipping.

Figure 1:
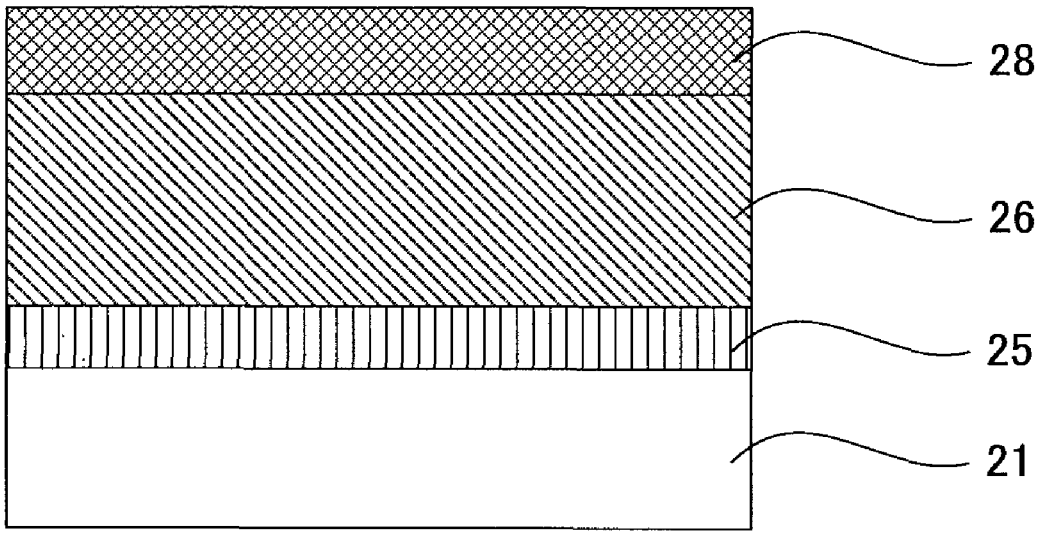
FIG. 1 is a schematic view of an electrophotographic photoconductor of the present invention.

DETAILED DESCRIPTION OF THE INVENTION (Electrophotographic Photoconductor)

An electrophotographic photoconductor of the present invention has an uppermost crosslinked surface layer. Specifically, the present electrophotographic photoconductor includes a support, a photoconductive layer and a crosslinked surface layer, with the layers being formed over the support; and, if necessary, further includes other layers.

<Crosslinked Surface Layer>

The crosslinked surface layer has a cured product of a crosslinked surface layer composition which contains a tri- or more functional radical-polymerizable monomer having no charge transportable structure, organosilica sol, an isocyanate group-containing radical-polymerizable monomer, a curable charge transport material, and which optionally contains a reactive silicone compound having a dimethylsiloxane structure as a repeating unit and having a radical-polymerizable functional group, a polymerization initiator and other components.

The crosslinked surface layer is an uppermost protective layer of the electrophotographic photoconductor. The crosslinked surface layer is a resin layer having a crosslinked structure. The resin layer is formed by polycondensing a coating layer of the crosslinked surface layer composition. This crosslinked resin layer has the highest wear resistance among the constituent layers of the photoconductor. In addition, this layer exhibits similar charge transferability to a charge transport layer, since it contains curable charge transport materials.

Importantly, the crosslinked surface layer composition contains organosilica sol and an isocyanate group-containing radical-polymerizable monomer (radical-polymerizable isocyanate compound). In order for organosilica to substantially function, the total content of these is preferably 10% by mass to 90% by mass, more preferably 30% by mass to 50% by mass on a solid basis.

—Organosilica Sol—

The organosilica sol is a stable dispersion of microparticles of silicic acid anhydride in an organic solvent. The organosilica sol may be appropriately synthesized or may be a commercially available product. Examples of the commercially available product include MKC silicate (product of Mitsubishi Chemical Corporation), silicate/acrylic varnish XP-1030-1 (product of Dainippon Shikizai Kogyo Co., Ltd.) (these two products are copolymers of alkoxysilyl compounds and acrylic resins or polyester resins), GR-COAT (product of DAICEL CHEMICAL INDUSTRIES, LTD.), GlassResin (product of Owens Corning Corporation), heatless glass (product of OHASHI CHEMICAL INDUSTRIES LTD.), NSC3456 (product of Nippon Fine Chemical), and glass stock solutions GO150SX and GO200CL (products of Fine Glass Technology Co., LTD.).

The organosilica sol is thermally crosslinked with a reactive silicone compound having a dimethylsiloxane structure as a repeating unit and having a radical-polymerizable functional group (described below) to form cured siloxane resins.

The cured siloxane resin is formed by thermally curing a composition containing, for example, the reactive silicone compound having a dimethylsiloxane structure as a repeating unit and having a radical-polymerizable functional group, organosilica sol, a catalyst, a crosslinking agent and a silane coupling agent.

—Reactive Silicone Compound Having a Dimethylsiloxane Structure as a Repeating Unit and Having Radical-Polymerizable Functional Group—

Examples of the reactive silicone compound include alkoxysilyl group-containing compounds, partially hydrolyzed condensates of alkoxysilyl group-compounds and mixtures thereof. Specific examples include compounds having a siloxane repeating unit of 20 to 70 described in, for example, Japanese Patent Application Publication Nos. 05-60503 and 06-45770; e.g., acryloylpolydimethylsiloxaneethyl, methacryloylpolydimethylsiloxaneethyl, acryloylpolydimethylsiloxanepropyl, acryloylpolydimethylsiloxanebutyl, and diacryloylpolydimethylsiloxanediethyl. The reactive silicone compound can be prepared by condensing esters of (meth) acrylic acid and alkylene glycol with a trimethylsilyl compound or a polydimethylsiloxane compound; or by adding esters of (meth)acrylic acid and allyl alcohol to a trimethylsilyl compound or a polydimethylsiloxane compound. Alternatively, commercially available products thereof may be used.

Examples of the commercially available product include, but not limited to, X-22-164A (M.W. 860), X-22-164B (M.W. 1,630), X-22-164C (M.W. 2,370), X-22-174DX (M.W. 4,600), X-24-8201 (M.W. 2,100) and X-22-2426 (M.W. 12,000) (these products are of Shin-Etsu Chemical Co. Ltd.); both-terminal SAILAPLANE FM-7711 (M.W. 1,000), both-terminal SAILAPLANE FM-7721 (M.W. 5,000), both-terminal SAILAPLANE FM-7725 (M.W. 10,000), mono-terminal SAILAPLANE FM-0711 (M.W. 1,000), mono-terminal SAILAPLANE FM-0721 (M.W. 5,000), mono-terminal SAILAPLANE FM-0725 (M.W. 10,000), mono-terminal SAILAPLANE TM-0701 (M.W. 423) and mono-terminal SAILAPLANE TM-0701T (M.W. 423) (these products are of CHISSO CORPORATION); BYK-UV3500, BYK-UV3510 and BYK-UV3570 (these products are of BYK Chemie Japan); and TEGO Rad2100, TEGO Rad2200N, TEGO Rad2250, TEGO Rad2500, TEGO Rad2600 and TEGO Rad2700 (these products are of TEGO CHEMIE SERVICE). These reactive silicone compounds may be used alone or in combination.

The reactive silicone compound content is preferably 0.01% by mass to 30% by mass, more preferably 0.05% by mass to 20% by mass, based on the solid content of the crosslinked surface layer composition. When the reactive silicone compound content is less than 0.01% by mass, the surface energy of the crosslinked surface layer does not decrease, causing a drop in cleaning performance. Whereas when the reactive silicone compound content is more than 30% by mass, uncured, unreacted components remain in a large amount, causing working failures such as fluctuation of electrical characteristics during repeated electrophotographic processes. As a result, a drop in image density and the thinning of printed characters may be generated.

—Isocyanate Group-Containing Radical-Polymerizable Monomer—

The isocyanate group-containing radical-polymerizable monomer (radical-polymerizable isocyanate) is not particularly limited and can be appropriately selected depending on the purpose. Examples thereof include 2-methacryloyloxyethyl isocyanate, 2-acryloyloxyethyl isocyanate and 1,1-bis(acryloyloxymethyl) ethylisocyanate. These compounds are preferably used for fabricating photoconductors with a sharp surface hardness distribution. Also, a crosslinked surface layer-composition containing these compounds does not exhibit poor curing performance. Furthermore, a crosslinked surface layer formed of the composition does not exhibit deteriorated electrostatic characteristics.

The isocyanate group-containing radical-polymerizable monomer may be appropriately synthesized or may be a commercially available product. Examples of the commercially available product include Karenz BEI, Karenz MOI and Karenz AOI (these products are of SHOWA DENKO K.K.).

The isocyanate group-containing radical-polymerizable monomer content is preferably 10 parts by mass to 30 parts by mass per 100 parts by mass of the organosilica sol.

—Tri- or More Functional Radical-Polymerizable Monomer Having No Charge Transportable Structure—

The tri- or more functional radical-polymerizable monomers having no charge transportable structure are monomers that do not have any of a hole transportable structure and an electron transportable structure (e.g., triarylamine, hydrazone, pyrazoline, carbazol, condensated polycyclic quinone, diphenoquinone, and an electron attractive aromatic ring having a cyano group and/or a nitro group) and that has three or more radical polymerizable functional groups. The radical-polymerizable functional group may be any of groups which have a carbon-carbon double bond and which are radically polymerizable.

Examples of the radical-polymerizable functional group include 1-substituted or 1,1-substituted ethylene functional groups as given below.

(1) The 1-substituted ethylene functional group is represented by, for example, the following formula:

$$CH_2{=}CH{-}X_1{-}$$

wherein $X_1$ represents an arylene group (e.g., phenylene and naphthylene) which may have a substituent; alkenylene group which may have a substituent; —CO— group; —COO— group; —CON($R_{10}$)— group (wherein $R_{10}$ represents a hydrogen atom; alkyl group (e.g., methyl and ethyl); aralkyl group (e.g., benzyl, naphthylmethyl and phenethyl); aryl group (e.g., phenyl and naphthyl)); or —S— group.

Examples of the substituent include a vinyl group, styryl group, 2-methyl-1,3-butadienyl group, vinylcarbonyl group, acryloyloxy group, acryloylamino group and vinylthioether group.

(2) The 1,1-substituted ethylene functional group is represented by, for example, the following formula:

$$CH_2{=}C(Y){-}X_2{-}$$

wherein Y represents an alkyl group which may have a substituent; aralkyl group which may have a substituent; aryl group (e.g., phenyl and naphthyl) which may have a substituent; halogen atom; cyano group; nitro group; alkoxy group (e.g. methoxy and ethoxy); and —$COOR_{11}$ group ((wherein $R_{11}$ represents a hydrogen atom; alkyl group (e.g., methyl and ethyl) which may have a substituent; aralkyl group (e.g., benzyl and phenethyl) which may have a substituent; aryl group (e.g., phenyl and naphthyl) which may have a substituent; or —$CONR_{12}R_{13}$ group (wherein $R_{12}$ and $R_{13}$, which may be identical or different, each represent a hydrogen atom; alkyl group (e.g., methyl and ethyl) which may have a substituent; aralkyl group (e.g. benzyl, naphthylmethyl and phenethyl) which may have a substituent; or aryl group (e.g., phenyl and naphthyl) which may have a substituent)); and $X_2$ represents any one of the groups described in relation to $X_1$, single bond, or alkylene group; with the proviso that at least one of Y and $X_2$ is an oxycarbonyl group, cyano group, alkenylene group or aromatic ring group.

Examples of the substituent include an α-chloroacryloyloxy group, methacryloyloxy group, α-cyanoethylene group, α-cyanoacryloyloxy group, α-cyanophenylene group and methacryloylamino group.

Examples of substituents which the substituent of groups represented by $X_1$, $X_2$ and Y has include a halogen atom; nitro group; cyano group; alkyl group (e.g., methyl and ethyl); alkoxy group (e.g., methoxy and ethoxy); aryloxy group (e.g., phenoxy); aryl group (phenyl and naphthyl); and aralkyl group (e.g., benzyl and phenethyl).

Among these radical-polymerizable functional groups, an acryloyloxy group and a methacryloyloxy group are particularly preferred. Compounds having three or more acryloyloxy groups can be produced by, for example, esterifying or transesterifying compounds having three or more hydroxyl groups in the molecule with an acrylic acid (salt), an acrylic halide or an acrylate. Similarly, compounds having three or more methacryloyloxy groups can be produced. Notably, in the three or more radical-polymerizable functional groups-containing monomers, radical-polymerizable functional groups may be identical or different.

The tri- or more functional radical-polymerizable monomer having no charge transportable structure is not particularly limited and can be appropriately selected depending on the purpose. Examples thereof include trimethylolpropane triacrylate (TMPTA), trimethylolpropane trimethacrylate, HPA-modified trimethylolpropane triacrylate, EO-modified trimethylolpropane triacrylate, PO-modified trimethylolpropane triacrylate, caprolactone-modified trimethylolpropane triacrylate, HPA-modified trimethylolpropane triacrylate, pentaerythritol triacrylate, pentaerythritol tetraacrylate (PETTA), glycerol triacrylate, ECH-modified glycerol triacrylate, EO-modified glycerol triacrylate, PO-modified glycerol triacrylate, tris(acryloxyethyl) isocyanulate, dipentaerythritol hexaacrylate (DPHA), caprolactone-modified dipentaerythritol hexaacrylate, dipentaerythritol hydroxypentaacrylate, alkyl-modified dipentaerythritol pentaacrylate, alkyl-modified dipentaerythritol tetraacrylate, alkyl-modified dipentaerythritol triacrylate, dimethylol propanetetraacrylate (DTMPTA), pentaerythritol ethoxyteteraacrylate, EO-modified phosphoric acid triacrylate and 2,2,5,5-tetrahydroxymethylcyclopentanone tetraacrylate. These monomers may be used alone or in combination. Of these, trimethylol propanetriacrylate (TMPTA) is particularly preferred.

In the tri- or more functional radical-polymerizable monomer having no charge transportable structure, the ratio of the molecular weight of the monomer to the number of the functional groups in the monomer (molecular weight/number of functional groups) is preferably 250 or less, from the viewpoint of forming a densely crosslinked structure in the crosslinked surface layer. When the ratio is more than 250, the crosslinked surface layer becomes soft and exhibits rather reduced wear resistance. Thus, it is not preferred that monomers having an extremely long modified group (e.g., HPA-, EO- or PO-modified group) are used alone.

The radical-polymerizable monomer content of the crosslinked surface layer composition is preferably 20% by mass to 80% by mass, more preferably 30% by mass to 70% by mass on a solid basis.

—Curable (Crosslinkable) Charge Transport Material—

The curable (crosslinkable) charge transport material is preferably monofunctional radical-polymerizable monomers having a charge transportable structure, more preferably those having an acryloyloxy group or a methacryloyloxy group. Particularly preferred are compounds represented by the following general formula (1):

General Formula (1)

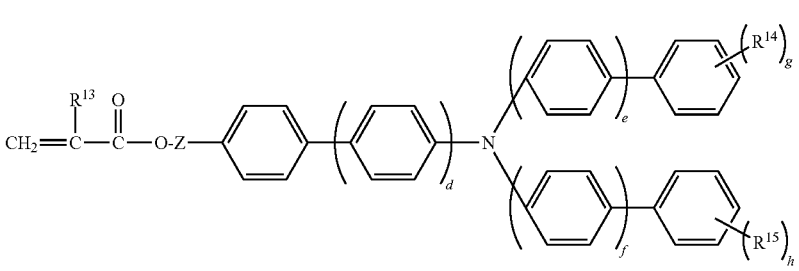

wherein $R^{13}$ represents a hydrogen atom or a methyl group; $R^{14}$ and $R^{15}$ each represent an alkyl group having 1 to 6 carbon atoms (preferably methyl or ethyl); g or h is an integer of 0 to 3; when g is two or three, $R^{14}$s may be identical or different; when h is two or three, $R^{15}$s may be identical or different; d, e or f is an integer of 0 or 1; and Z represents a single bond, a methylene group, an ethylene group or any one of groups represented by the following structural formulas:

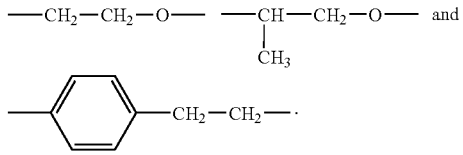

The curable charge transport material is preferably a material which has high charge transferability and which effectively receives charges from the charge transport layer provided under the crosslinked surface layer. Most preferred are charge transport monomers used for synthesizing a charge transport polymer disclosed in JP-A No. 2001-330973. When the amount of substance per one functional group participating in curing (equivalent) is low, the curing agent (reactant) content of the curable resin surface layer must be high, resulting in limiting the maximum content of the curable charge transport material. In consideration of formulation of the layer, materials having a high equivalent are preferably used. Specifically, those having an equivalent of 200 or higher are preferable.

Examples of preferred curable charge transport materials include Compounds No. 1 to No. 160 described in paragraphs [0111] to [0122] of JP-A No. 2007-171939. Particularly preferred are 4'-(di-p-tolylamino)-biphenyl-4-yl acrylate, 4'-(di-p-tolylamino)-biphenyl-4-yl 2-methyl-acrylate, 4'-diphenylamino-biphenyl-4-yl acrylate, 4'-diphenylamino-biphenyl-4-yl 2-methyl-acrylate, (4-[bis-(4-methoxyphenyl)-methyl]-diphenyl-amine, (4-[bis-(4-ethoxyphenyl)-methyl]-diphenyl-amine, (4-[bis-(4-methoxyphenyl)-methyl]-di-p-tolyl-amine, (4-[bis-(4-ethoxyphenyl)-methyl]-di-p-tolyl-amine, 4'-[(di-p-tolyl-amino)-biphenyl-4-yl-oxy]-methanol, and 4'-[(di-p-tolyl-amino)-biphenyl-4-yl-oxy]-ethanol. These compounds may be used alone or in combination.

The curable charge transport material content of the crosslinked surface layer composition is preferably 5% by mass to 60% by mass, more preferably 5% by mass to 30% by mass on a solid basis. When the content is less than 5% by mass, the composition may provide a cured product with reduced wear resistance.

—Polymerization Initiator—

Upon forming the crosslinked surface layer, a thermo- or photo-polymerization initiator may be optionally added to the composition for effectively proceeding curing reaction.

The thermopolymerization initiator is not particularly limited and can be appropriately selected depending on the purpose. Examples thereof include peroxide initiators such as 2,5-dimethylhexane-2,5-dihydro peroxide, dicumyl peroxide, benzoyl peroxide, t-butylcumyl peroxide, 2,5-dimethyl-2,5-di(peroxybenzoyl)hexyne, di-t-butyl peroxide, t-butylhydro peroxide, cumenehydro peroxide and lauroyl peroxide; and azo initiators such as azobisisobutylonitrile, azobiscyclohexanecarbonitrile, methyl azobisisobutylate, azobisisobutylamidine hydrochloride and 4,4'-azobis-4-cyanovaleric acid.

The photopolymerization initiator is not particularly limited and can be appropriately selected depending on the purpose. Example thereof include acetophenone or ketal photopolymerization initiators such as diethoxyacetophenone, 2,2-dimethoxy-1,2-diphenylethan-1-one, 1-hydroxycyclohexylphenylketone, 4-(2-hydroxyethoxy)phenyl(2-hydroxy-2-propyl)ketone, 2-benzyl-2-dimethylamino-1-(4-morpholinophenyl)butanone-1,2-hydroxy-2-methyl-1-phenylpropan-1-one, 2-methyl-2-morpholino(4-methylthiophenyl)propan-1-one and 1-phenyl-1,2-propanedione-2-(o-ethoxycarbonyl)oxime; benzoine ether photopolymalization initiators such as benzoine, benzoine methyl ether, benzoine ethyl ether, benzoine isobutyl ether and benzoine isopropyl ether; benzophenone photopolymerization initiators such as benzophenone, 4-hydroxybenzophenone, methyl o-benzoylbenzoate, 2-benzoylnaphthalene, 4-benzoylbiphenyl, 4-benzoyl phenyl ether, acrylated benzophenone and 1,4-benzoylbenzene; thioxanthone photopolymerization initiators such as 2-isopropylthioxanthone, 2-chlorothioxanthone, 2,4-dimethylthioxanthone and 2,4-diethylthioxanthone and 2,4-dichlorothioxanthone; and ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenylglyoxy ester, 9,10-phenanthrene, acridine compounds, triazine compounds and imidazol compounds.

Separately, a compound promoting photopolymerization can be used alone or in combination with the above photopolymerization initiators. Examples of the compound include triethanolamine, methyldiethanolamine, ethyl 4-dimethylaminobenzoate, isoamyl 4-dimethylaminobenzoate, (2-dimethylamino)ethyl benzoate and 4,4'-dimethylaminobenzophenone.

These polymerization initiators may be used in combination. The polymerization initiator content is preferably 0.5 parts by mass to 40 parts by mass, more preferably 1 part by mass to 20 parts by mass, per 100 parts by mass of all the radical-polymerizable compounds.

If necessary, the crosslinked surface layer may contain, for example, a leveling agent and a low-molecular-weight compound (e.g., antioxidants, plasticizers, lubricants and UV absorbers). These compounds may be used alone or in combination. Use of the low-molecular-weight compound and leveling agent in combination may lead to deteriorated sensitivity in many cases. The amount of the low-molecular-weight compounds is preferably about 0.1% by mass to about 20% by mass, more preferably about 0.1% by mass to about 10% by mass, based on the total solid content of the crosslinked surface layer-coating liquid. The amount of the leveling agent is preferably 0.1% by mass to 5% by mass.

The dispersion solvent used for preparing the crosslinked surface layer composition is not particularly limited and can be appropriately selected depending on the purpose. The solvent capable of sufficiently dissolving the monomers is preferably used. Examples thereof include ether solvents, aromatic solvents, halogen-containing solvents, ester solvents, cellosolves (e.g., ethoxyethanol) and propylene glycols (e.g., 1-methoxy-2-propanol). Notably, methyl ethyl ketone, tetrahydrofuran, cyclohexanone and 1-methoxy-2-propanol give less environment load and preferable than chlorobenzene, dichloromethane, toluene and xylene. These solvents may be used alone or in combination.

The method for coating the crosslinked surface layer composition is not particularly limited and can be appropriately selected depending on the purpose. Examples thereof include dip coating, spray coating, ring coating, a roll coater method, gravure coating, nozzle coating and screen printing. The coating liquid generally does not have a long pot life and thus, there are advantageous methods by which the desired coating layers can be formed by applying the coating liquid even in a small amount, from the viewpoints of environmental protection and cost reduction. Among the above methods, spray coating and ring coating are particularly preferred.

In formation of the crosslinked surface layer, there may be used a UV-irradiating light source such as a high-pressure mercury lamp and metal halide lamp mainly having an emission wavelength in the UV region. Also, a light source emitting visible lights may be used depending on the wavelengths of light absorbed by the radical-polymerizable compounds and photopolymerization initiators. The irradiation dose is preferably 50 mW/cm$^2$ to 1,000 mW/cm$^2$. When the irradiation dose is less than 50 mW/cm$^2$, curing reaction may consume a lot of time for completion. Whereas, when the irradiation dose is more than 1,000 mW/cm$^2$, curing reaction does not isotropically proceed, causing localized wrinkles on the crosslinked surface layer. In addition, many unreacted groups and reaction-termination ends may be generated. Furthermore, crosslinking reaction proceeds excessively rapidly and thus, the internal stress of the formed crosslinked surface layer becomes large, causing cracking and film-peeling thereof.

The thickness of the crosslinked surface layer is not particularly limited and can be appropriately determined depending on the purpose. The thickness is preferably 3 μm to 15 μm. The lower limit of the thickness is determined in consideration of cost-effectiveness regarding film formation. The upper limit of the thickness is determined in consideration of electrostatic characteristics (e.g., charge stability and photo-induced discharge sensitivity) and uniformity of film quality.

<Layer Structure of Electrophotographic Photoconductor>

The layer structure of the present electrophotographic photoconductor is not particularly limited and can be appropriately selected depending on the purpose. The electrophotographic photoconductor includes, in sequence, a support, a multi-layer photoconductive layer (formed of a charge generation layer and a charge transport layer) and a crosslinked surface layer. If necessary, the electrophotographic photoconductor may contain an undercoat layer. In either case, the crosslinked surface layer is an uppermost layer of the photoconductor. Alternatively, the present electrophotographic photoconductor includes, in sequence, a support, a single-layer photoconductive layer formed mainly of a charge generation material and a charge transport material, and a crosslinked surface layer.

Figure 2:
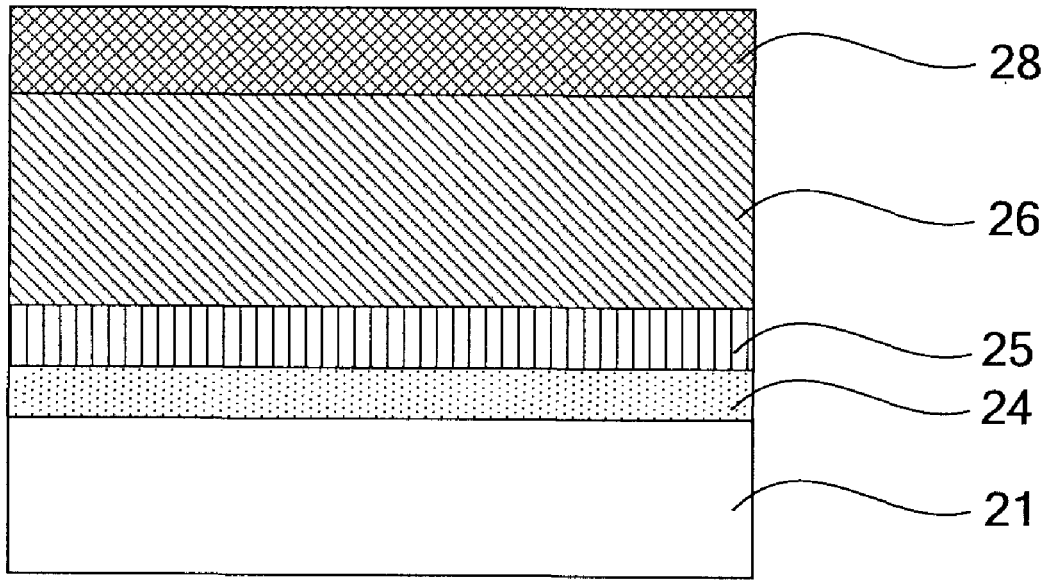
FIG. 2 is a schematic view of another electrophotographic photoconductor of the present invention.

With reference to the drawings, next will be described the layer structure of the present electrophotographic photoconductor. FIGS. 1 and 2 are schematic cross-sectional views of the electrophotographic photoconductor.

The electrophotographic photoconductor shown in FIG. 1 includes, in sequence, a support 21, a charge generation layer 25 formed mainly of a charge generation material, a charge transport layer 26 formed mainly of a charge transport material, and a crosslinked surface layer 28 formed of the crosslinked surface layer composition in the present invention.

The electrophotographic photoconductor shown in FIG. 2 includes, in sequence, a support 21, an undercoat layer 24, a charge generation layer 25 formed mainly of a charge generation material, a charge transport layer 26 formed mainly of a charge transport material, and a crosslinked surface layer 28 formed of the crosslinked surface layer composition in the present invention.

—Support—

The support is not particularly limited, so long as it exhibits a volume resistivity of $10^{10}$ Ω·cm or less, and can be appropriately selected depending on the purpose. Examples thereof include coated products formed by coating, on film-form or cylindrical plastic or paper, a metal (e.g, aluminum, nickel, chromium, nichrome, copper, gold, silver or platinum) or a metal oxide (e.g., tin oxide or indium oxide) by vapor deposition or sputtering; and also include an aluminum plate, an aluminum alloy plate, a nickel plate and a stainless steel plate. Furthermore, there may be used tubes produced as follows: the above metal plates are formed into a raw tube through extrusion, pultrusion, etc.; and the raw tube was cut and was subjected to surface treatments such as superfinishing and polishing. Also, an endless nickel belt or an endless stainless-steel belt described in JP-A No. 52-36016 may be used as the support.

Furthermore, the support may be provided with a coating layer formed of a dispersion of conductive powder in an appropriate binder resin.

Examples of the conductive powder include carbon black, acetylene black; powder of a metal such as aluminum, nickel, iron, nichrome, copper, zinc or silver; and powder of a metal oxide such as conductive tin oxide or ITO. Examples of the binder resin which is used in combination with the conductive powder include polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate, polyvinylidene chloride, polyarylate resins, phenoxy resins, polycarbonate resins, cellulose acetate resins, ethyl cellulose resins, polyvinyl butyral resins, polyvinyl formal resins, polyvinyl toluene resins, poly-N-vinylcarbazole, acrylic resins, silicone resins, epoxy resins, melamine resins, urethane resins, phenol resins and alkyd resins. These may be used alone or in combination.

Such a conductive layer may be formed by coating a dispersion of the conductive powder and the binder resin in an appropriate solvent (e.g., tetrahydrofuran, dichloromethane, methyl ethyl ketone or toluene).

In addition, the support may be formed by providing an appropriate cylindrical support with, as a conductive layer, a heat-shrinkable tubing containing the conductive powder and a material (e.g., polyvinyl chloride, polypropylene, polyester, polystyrene, polyvinylidene chloride, polyethylene, chlorinated rubber or Teflon (registered trademark)).

—Undercoat Layer—

An undercoat layer may be provided between a support and a photoconductive layer. The undercoat layer is provided for enhancing adhesiveness between the support and the photoconductive layer, for preventing moire generation, for imparting improved coating properties to the layer thereon, and for preventing the support from injecting charges.

The undercoat layer is made mainly of resin. Since the photoconductive layer is formed on the undercoat layer, the undercoat layer is preferably made of thermosetting resin that is sparingly soluble in organic solvents. Examples of the resin include polyurethane, melamine resins and alkyd-melamine resins. These resins may be appropriately diluted, in use, with a solvent such as tetrahydrofuran, cyclohexanone, dioxane, dichloroethane or butanone.

The undercoat layer may contain microparticles of metal, metal oxide, etc. for adjusting conductivity and preventing moire generation. Particularly preferred metal oxide is titanium oxide.

The microparticles are dispersed in a solvent (e.g., tetrahydrofuran, cyclohexanone, dioxane, dichloroethane or butanone) using a ball mill, an attritor or a sand mill. The resultant dispersion is mixed with resin components to form an undercoat layer-coating liquid.

The undercoat layer is formed by coating the undercoat layer-coating liquid on a support with, for example, dip coating, spray coating or bead coating. If necessary, the coated liquid is thermally cured.

The thickness of the undercoat layer is preferably 2 μm to 5 μm. When the residual potential of the photoconductor increases, the thickness is preferably less than 3 μm.

<Photoconductive Layer>

The photoconductive layer is preferably a laminated photoconductive layer including, in sequence, a charge generation layer and a charge transport layer.

—Charge Generation Layer—

The charge generation layer has the function of generating charges upon light exposure. This layer is formed predominantly of a charge generation material. The charge generation layer may contain binder resin in accordance with needs. The charge generation material may be an inorganic or organic material.

The inorganic material is not particularly limited and can be appropriately selected depending on the purpose. Examples thereof include crystalline selenium, amorphous selenium, selenium-tellurium compounds, selenium-tellurium-halogen compounds and amorphous silicon. Preferably used amorphous silicone is those in which the dangling bonds are terminated with hydrogen atoms or halogen atoms; or which are doped with a boron atom, a phosphorus atom, etc.

The organic material is not particularly limited and may be any known material. Examples thereof include metal phthalocyanine (e.g., titanyl phthalocyanine and chlorogallium phthalocyanine), metal-free phthalocyanine, azulenium pigments, methine squarate pigments, symmetric or asymmetric azo pigments having a carbazole skeleton, symmetric or asymmetric azo pigments having a triphenylamine skeleton, symmetric or asymmetric azo pigments having a fluorenone skeleton and perylene pigments. These may be used alone or in combination. Of these, metal phthalocyanine, symmetric or asymmetric azo pigments having a fluorenone skeleton, symmetric or asymmetric azo pigments having a triphenylamine skeleton, and perylene pigments are preferred, since they exhibit considerably high quantum efficiency of charge generation.

Examples of the binder resin include polyamide, polyurethane, epoxy resins, polyketone, polycarbonate, polyarylate, silicone resins, acrylic resins, polyvinylbutyral, polyvinylformal, polyvinyl ketone, polystyrene, poly-N-vinylcarbazole and polyacrylamide. These may be used alone or in combination.

The method for forming the charge generation layer is generally based on a vacuum thin-film formation method or a casting method using a dispersion system.

Examples of the vacuum thin-film formation method include vacuum vapor deposition, glow discharge decomposition, ion plating, sputtering, reactive sputtering and chemical vapor deposition (CVD). Any of these methods can successfully form a layer from the above inorganic or organic materials.

When the casting method is employed, a layer can be formed as follows: the above inorganic or organic charge generation materials are dispersed, optionally together with binder resin, in a solvent (e.g., tetrahydrofuran, cyclohexanone, dioxane, dichloroethane or butanone) with, for example, a ball mill, an attritor or a sand mill; and the dispersion is appropriately diluted before coating. Here, methyl ethyl ketone, tetrahydrofuran and cyclohexanone give less environment load and preferable than chlorobenzene, dichloromethane, toluene and xylene. Examples of the coating method include dip coating, spray coating and bead coating.

The thickness of the charge generation layer is preferably 0.01 μm to 5 μm. Provision of the thick charge generation layer, in some cases, attains reduced residual potential and higher sensitivity, and in other cases, leads to deteriorated charging properties (e.g., poor charge retentability and space charge formation). In view of this, the thickness of the charge generation layer is preferably 0.05 μm to 2 μm.

If necessary, the charge generation layer may contain, for example, a leveling agent and a low-molecular-weight compound (e.g., antioxidants, plasticizers, lubricants and UV absorbers (described below)). These compounds may be used alone or in combination. Use of the low-molecular-weight compound and leveling agent in combination may lead to deteriorated sensitivity in many cases. The amount of the low-molecular-weight compounds is preferably 0.1 parts by mass to 20 parts by mass, more preferably 0.1 parts by mass to 10 parts by mass. The amount of the leveling agent is preferably 0.001 parts by mass to 0.1 parts by mass.

—Charge Transport Layer—

The charge transport layer is a member of the multi-layer photoconductor layer. Through this layer, charges generated in the charge generation layer are transported to neutralize the photoconductor-surface charges given by charging.

The charge transport layer includes a charge transport material and a binder component and, if necessary, includes other components.

Examples of the charge transport material include low-molecular-weight electron transport materials, hole transport materials and charge transport polymers.

Examples of the electron transport material include electron-accepting materials such as asymmetric diphenoquinone derivatives, fluorene derivatives and naphthalimide derivatives. These may be used alone or in combination.

Examples of preferred hole transport materials include electron-donating materials. Examples of the electron-donating material include, oxazole derivatives, oxadiazole derivatives, imidazole derivatives, triphenylamine derivatives, butadiene derivatives, 9-(p-diethylaminostyrylanthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives and thiophene derivatives. These may be used alone or in combination.

Examples of the charge transport polymer include carbazole ring-containing polymers (e.g., poly-N-vinylcarbazole); polymers having a hydrazone structure (e.g., those described in, for example, JP-A No. 57-78402); polysilylene polymers described in, for example, JP-A No. 63-285552; and aromatic polycarbonates represented by general formulas (1) to (6) in JP-A No. 2001-330973. These charge transport polymers may be used alone or in combination. Among them, aromatic polycarbonates described in JP-A No. 2001-330973 are particularly preferred, since they have excellent electrostatic characteristics.

The charge transport polymer percolates the crosslinked surface layer in a smaller amount than does the low-molecular-weight charge transport material, and thus, is suitable for preventing insufficient curing of the crosslinked surface layer. In addition, the charge transport layer formed of the charge transport polymer is advantageously less susceptible to curing heat applied during formation of the crosslinked surface layer, since the charge transport polymer has excellent heat resistance.

Examples of polymers which can be used as the binder component of the charge transport layer include polystyrene, polyester, polyvinyl, polyarylate, polycarbonate, acrylic resins, silicone resins, fluorine resins, epoxy resins, melamine resins, urethane resins, phenol resins and alkyd resins. These may be used alone or in combination. In general, polystyrene, polyester, polyarylate and polycarbonate exhibit excellent charge transferability, and these polymers are advantageously used as the binder component for charge transfer components. The charge transport layer is provided thereon with the crosslinked surface layer, and the charge transport layer is not required to have mechanical strength comparable to a conventional charge transport layer. Thus, as the binder component of the charge transport layer, there can be effectively used highly transparent materials (e.g., polystyrene) which have rather low mechanical strength and which have been difficult to be applicable to prior arts.

These polymers may be used alone or in combination. Also, two or more types of monomers forming the polymers may be copolymerized. Furthermore, these monomers may be copolymerized with charge transport materials.

The charge transport layer may be altered in its properties using an electrically inactive polymer. Examples of the electrically inactive polymer include cardo-type polyesters containing a bulky skeleton such as fluorene; polyesters such as polyethylene terephthalate and polyethylene naphthalate; polycarbonates derived from bisphenol polycarbonates (e.g., C type polycarbonates) so that the phenol moiety has alkyl groups at its 3,3'-positions as a substituent; polycarbonates derived from bisphenol A so that the geminal methyl group is substituted with a long-chain alkyl group having two or more carbon atoms; polycarbonates having a biphenyl skeleton or a biphenyl ether skeleton; polycarbonates having a long-chain alkyl skeleton (e.g., polycaprolactone) (see JP-A No. 07-292095; acrylic resins; polystyrene; and hydrogenated polybutadiene.

As used herein, the electrically inactive polymer refers to a polymer which does not have a photoconductive chemical structure such as a triarylamine structure.

When such a polymer (resin) is used in combination with the binder resin, the polymer content is preferably 50% by mass or less based on the total solid content of the charge transport layer, in consideration of limitation on photo-induced discharge sensitivity.

When the low-molecular-weight charge transport material is used, the amount thereof is preferably 40 parts by mass to 200 parts by mass, more preferably 70 parts by mass to 100 parts by mass, per 100 parts by mass of the binder resin. When the charge transport polymer is used, preferred are copolymers of 100 parts by mass of a charge transport component and preferably 200 parts by mass or less (more preferably about 80 parts by mass to about 150 parts by mass) of a resin component.

When two or more charge transport materials are incorporated into the charge transport layer, the difference in ionization potential is preferably smaller between these materials. Specifically, when the difference(s) is adjusted to 0.10 eV or less, one charge transport material is prevented from acting as a charge trap material for the other(s).

Similarly, the difference in ionization potential is preferably adjusted to 0.10 eV between the below-described curable charge transport material and the charge transport material contained in the charge transport layer.

The ionization potential of the charge transport material can be measured using, for example, an atmospheric-ultraviolet photoelectron spectrometer (AC-1, product of RIKEN KEIKI Co., Ltd.).

The charge transport component is preferably used in an amount of 70 parts by mass or more for attaining higher sensitivity. Separately, in general, α-phenylstilbene compounds, benzidine compounds and mono- or di-meric butadiene compounds have high charge mobility. Also, charge transport polymers whose main or side chains are derived from these compounds generally have high charge mobility. Thus, these are useful for the charge transport material.

Examples of dispersion solvents which can be used for preparing the charge transport layer-coating liquid include ketones such as methyl ethyl ketone, acetone, methyl isobutyl ketone and cyclohexanone; ethers such as dioxane, tetrahydrofuran and ethyl cellosolve; aromatic compounds such as toluene and xylene; halogenated compounds such as chlorobenzene and dichloromethane; and esters such as ethyl acetate and butyl acetate. These may be used alone or in combination. Among them, methyl ethyl ketone, tetrahydrofuran and cyclohexanone are preferred, since they give less environment load.

The charge transport layer may be formed as follows: a charge transport component is mixed or copolymerized with a binder component; the mixture or copolymer is dissolved or dispersed in an appropriate solvent; the solution or dispersion is coated; and the coated product is dried. Examples of the coating method employed in formation of the charge transport layer include dip coating, spray coating, ring coating, a roll coater method, gravure coating, nozzle coating and screen printing.

As described above, the charge transport layer is provided thereon with the crosslinked surface layer. Thus, the thickness of the charge transport layer can be small, since the thickness is not required to be large in consideration of film ablation during practical use.

Practically, the thickness of the charge transport layer is preferably 10 μm to 40 μm, more preferably 15 μm to 30 μm, from the viewpoint of ensuring the required sensitivity and charging ability.

If necessary, the charge transport layer may contain, for example, a leveling agent and a low-molecular-weight compound (e.g., antioxidants, plasticizers, lubricants and UV absorbers). These compounds may be used alone or in combination. Use of the low-molecular-weight compound and leveling agent in combination may lead to deteriorated sensitivity in many cases. The amount of the low-molecular-weight compounds is preferably about 0.1 parts by mass to about 20 parts by mass, more preferably about 0.1 parts by mass to about 10 parts by mass. The amount of the leveling agent is preferably 0.001 parts by mass to 0.1 parts by mass.

Examples of the antioxidant include phenol compounds, p-phenylenediamine compounds, hydroquinone compounds, organic sulfur-containing compounds and organic phosphorus-containing compounds. These may be used alone or in combination.

Examples of the phenol compound include 2,6-di-t-butyl-p-cresol, butylated hydroxyanisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3,-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester and tocopherols.

Examples of the p-phenylenediamine compound include N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine and N,N'-dimethyl-N,N'-di-t-butyl-p-phenylenediamine.

Examples of the hydroquinone compound include 2,5-di-t-octylhydroquinone, 2,6-didodecylhydroquinone, 2-dodecylhydroquinone, 2-dodecyl-5-chlorohydroquinone, 2-t-octyl-5-methylhydroquinone and 2-(2-octadecenyl)-5-methylhydroquinone.

Examples of the organic sulfur-containing compound include dilauryl-3,3'-thiodipropionate, distearyl-3,3'-thiodipropionate and ditetradecyl-3,3'-thiodipropionate.

Examples of the organic phosphorus-containing compound include triphenylphosphine, tri(nonylphenyl)phosphine, tri(dinonylphenyl)phosphine, tricresylphosphine and tri(2,4-dibutylphenoxy)phosphine.

These compounds are known as an antioxidant for rubber, plastic or oils and fats, and commercially available products thereof are easily obtained.

The amount of the antioxidant which is incorporated into a layer is not particularly limited and can be appropriately determined depending on the purpose. Preferably, the amount is 0.01% by mass to 10% by mass based on the total amount by mass of the layer.

(Image Forming Apparatus and Process)

An image forming apparatus of the present invention includes the electrophotographic photoconductor, a latent electrostatic image forming unit, a developing unit, a transferring unit and a cleaning unit, and if necessary, further includes a fixing unit and appropriately selected other units such as a charge-eliminating unit, a recycling unit and a controlling unit.

Preferably, the present image forming apparatus is a tandem apparatus including image forming components such as the electrophotographic photoconductor, a charging unit, a developing unit, a transferring unit and a cleaning unit; and polymerization toner is used in the developing unit.

An image forming process of the present invention includes a latent electrostatic image forming step, a developing step, a transferring step and a cleaning step, and if necessary, further includes a fixing step and appropriately selected other steps such as a charge-eliminating step, a recycling step and a controlling step.

The present image forming process can be preferably performed by the present image forming apparatus; the latent electrostatic image forming step can be performed by the latent electrostatic image forming unit; the developing step can be performed by the developing unit; the transferring step can be performed by the transferring unit; the cleaning step can be performed by the cleaning unit; the fixing step can be performed by the fixing unit; and the other steps can be performed by the other units.

—Latent Electrostatic Image Forming Step and Unit—

The latent electrostatic image forming step is a step of forming a latent electrostatic image on the electrophotographic photoconductor.

In this step, the present electrophotographic photoconductor is used.

The latent electrostatic image can be formed by the latent electrostatic image forming unit. Specifically, the surface of the electrophotographic photoconductor is uniformly charged and then imagewise exposed to light, to form the latent electrostatic image. The latent electrostatic image forming unit includes, for example, a charger for uniformly charging the electrophotographic photoconductor surface; and an exposing device for imagewise exposing the charged surface to light.

The electrophotographic photoconductor surface can be charged by application of voltage, for example, using the above charger.

The charger is not particularly limited and can be appropriately selected depending on the purpose. Examples of the charger include known contact chargers having a conductive or semiconductive roller, brush, film or rubber blade; and non-contact chargers employing corona discharge (e.g., a corotron and a scorotron).

The charged electrophotographic photoconductor surface can be imagewise exposed to light, for example, using the exposing device.

The exposing device is not particularly limited, so long as it attains desired imagewise exposure, and can be appropriately selected depending on the purpose. Examples of the exposing device include various exposing devices such as a copy optical exposing device, a rod lens array exposing device, a laser optical exposing device and a liquid crystal shutter exposing device.

In the present invention, light may be imagewise applied from the side facing the photoconductor support.

When the image forming apparatus is used as a copier or printer, the imagewise light exposure is performed by applying reflected or transmitted light from an original text to the photoconductor; or by a process including reading an original text with a sensor for conversion to signals, and driving an LED array or a liquid crystal shutter array following the signals for applying light to the photoconductor.

—Developing Step and Unit—

The developing step is a step of forming a visible image by developing the latent electrostatic image with toner (developer).

The visible image can be formed by, for example, developing the latent electrostatic image with toner (developer) in the developing unit.

The developing unit is not particularly limited, so long as it attains developing with toner (developer), and can be appropriately selected from known developing units. Examples of preferred developing units include those having a developing device which has toner (developer) therein and which can apply toner (developer) to the latent electrostatic image in a contact or non-contact manner.

The toner is not particularly limited and can be appropriately selected depending on the purpose. Polymerization toner is preferably used.

The polymerization toner is formed as follows: toner materials containing a colorant and a modified polyester resin capable of forming a urea or urethane bond are dissolved or dispersed in an organic solvent; the solution or dispersion is dispersed in an aqueous solvent for proceeding polyaddition reaction; and the solvent is removed from the resultant dispersion, followed by washing.

The modified polyester resin capable of forming a urea or urethane bond is produced as follows: a polyvalent isocyanate compound (PIC) is reacted with, for example, a carboxylic or hydroxyl group present at the end of polyester to produce an isocyanate group-containing polyester prepolymer; and the resultant polyester prepolymer is reacted with an amine compound for crosslinking and/or elongation of the molecular chain. The toner formed from the modified polyester resin exhibits improved hot-offset performance while maintaining a sufficient low-temperature fixing property.

Examples of the polyvalent isocyanate compound (PIC) include aliphatic polyvalent isocyanates (e.g., tetramethylene diisocyanate, hexamethylene diisocyanate, 2,6-diisocyanatomethylcaproate); alicyclic polyisocyanates (e.g., isophorone diisocyanate, cyclohexylmethane diisocyanate); aromatic diisocyanates (e.g., tolylene diisocyanate, diphenylmethane diisocyanate); aromatic/aliphatic diisocyanates (e.g., $\alpha,\alpha,\alpha',\alpha'$-tetramethylxylylenediisocyanate); isocyanates; and blocked products of the above polyisocyanates with, for example, phenol derivatives, oximes, or caprolactams. These may be used alone or in combination.

The ratio of polyvalent isocyanate compound (PIC) to hydroxyl group-containing polyester is preferably 5/1 to 1/1, more preferably 4/1 to 1.2/1, still more preferably 2.5/1 to 1.5/1, in terms of the equivalent ratio [NCO]/[OH] of isocyanate group [NCO] to hydroxyl group [OH].

The isocyanate group-containing polyester prepolymer (A) contains preferably one or more isocyanate groups in the molecule. More preferably, the prepolymer (A) contains, on average, 1.5 to 3 isocyanate groups, still preferably 1.8 to 2.5 isocyanate groups.

Examples of the amine compound (B) which is reacted with the polyester prepolymer include divalent amine compounds (B1), tri- or more-valent amine compounds (B2), amino alcohols (B3), aminomercaptans (B4), amino acids (B5), and amino-blocked products (B6) of the amine compounds (B1) to (B5).

Examples of the divalent amine compound (B1) include aromatic diamines (e.g., phenylenediamine, diethyltoluenediamine and 4,4'-diaminodiphenylmethane); alicyclic diamines (e.g., 4,4'-diamino-3,3'-dimethyldicyclohexylmethane, diaminocyclohexane, isophoronediamine); and aliphatic diamines (e.g., ethylenediamine, tetramethylenediamine and hexamethylenediamine).

Examples of the tri- or more-valent amine compound (B2) include diethylenetriamine and triethylenetetramine.

Examples of the amino alcohol (B3) include ethanolamine and hydroxyethylaniline.

Examples of the aminomercaptan (B4) include aminoethyl mercaptan and aminopropyl mercaptan.

Examples of the amino acid (B5) include aminopropionic acid and aminocaproic acid.

Examples of the amino-blocked product (B6) include ketimine compounds and oxazolidine compounds derived from the amine compounds (B1) to (B5) and ketones (e.g., acetone, methyl ethyl ketone and methyl isobutyl ketone). Among these amine compounds (B), the divalent amine compounds (B1) are particularly preferred. Also, particularly preferred are mixtures of the divalent amine compounds (B1) and a small amount of the polyvalent amine compounds (B2).

The ratio of isocyanate group-containing polyester prepolymer (A) to amine compound (B) is preferably 1/2 to 2/1, more preferably 1.5/1 to 1/1.5, still more preferably 1.2/1 to 1/1.2, in terms of the equivalent ratio [NCO]/[NHx] of isocyanate group [NCO] to amino group [NHx].

The polymerization method as described above can produce small, spherical toner particles at low cost and with low environment load.

The above developing device usually employs a dry developing process, and may be a single-color or multi-color developing device. Examples of preferred developing devices include those having a rotatable magnetic roller and a stirrer for charging toner particles (developer) with friction caused during stirring.

In the developing device, toner particles and carrier particles are stirred so that the toner particles are charged by friction generated therebetween. The charged toner particles are retained in the chain-like form on the surface of the rotating magnetic roller to form a magnetic brush. The magnetic roller is disposed proximately to the electrophotographic photoconductor and thus, some of the toner particles forming the magnetic brush are electrically adsorbed onto the electrophotographic photoconductor surface. As a result, the latent electrostatic image is developed with toner to form a visual toner image on the electrophotographic photoconductor surface.

The developer provided in the developing device is a toner particles-containing developer, and may be a one- or two-component developer. The toner particles may be a generally used product.

—Transferring Step and Unit—

The transferring step is a step of transferring the visible images to a recording medium. In this step, preferably, the visible images are primarily transferred to an intermediate transfer member, and the thus-transferred visible images are secondarily transferred to the recording medium. Also, toners of two or more colors are used (a full color toner is preferably used). More preferably, the transferring step includes a primary-transferring step for forming a transferred composite image by transferring the visible images to an intermediate member; and a secondary-transferring step for transferring the transferred composite image to a recording medium.

For example, the visible image can be transferred in the transferring unit by charging the electrophotographic photoconductor with a transfer charger. Preferably, the transferring unit includes a primary-transferring unit for forming a transferred composite image by transferring the visible images to an intermediate member; and a secondary-transferring unit for transferring the transferred composite image to a recording medium.

The intermediate transfer member is not particularly limited and can be appropriately selected from known transfer members depending on the purpose. Examples of preferred intermediate transfer members include a transferring belt.

The transferring unit (consisting of the primary- and secondary-transferring units) preferably includes a transferring device which transfers the visible images from the electrophotographic photoconductor onto the recording medium. The image forming apparatus may include at least one transferring unit.

Examples of the transferring device include a corona transferring device employing corona discharge, a transfer belt, a transfer roller, a pressing transfer roller and an adhesive transferring device.

The recording medium is not particularly limited, so long as it can receive a developed, unfixed image, and can be appropriately selected depending on the purpose. Examples of the recording medium include plain paper and a PET base for OHP. Typically, plain paper is used.

—Fixing Step and Unit—

The fixing step is a step of fixing, with a fixing device, the visible image which has been transferred to the recording medium. The fixing step may be performed every after a toner image of each color is transferred onto the recording medium; or may be performed at one time after toner images of all colors are superposed on the recording medium.

The fixing device is not particularly limited and can be appropriately selected depending on the purpose. A known heating-pressing device is preferably used. Examples of the heating-pressing device include a combination of a heating roller and a pressing roller; and a combination of a heating roller, a pressing roller and an endless belt.

Generally, the heating temperature by the heating-pressing unit is preferably at 80° C. to 200° C.

In the fixing step in the present invention, a known photofixing device or a similar device is used together with or instead of the fixing unit depending on the purpose.

—Cleaning Step and Unit—

The cleaning step is a step of cleaning the electrophotographic photoconductor surface with the cleaning unit.

Examples of the cleaning unit include a cleaning blade, a magnetic blush cleaner, an electrostatic brush cleaner, a magnetic roller cleaner, a blade cleaner, a brush cleaner and a web cleaner.

The electrophotographic photoconductor can be cleaned with any cleaning method by virtue of decrease in adhesion force between small, spherical toner particles and the electrophotographic photoconductor. In consideration of its downsizing, simplification, durability and applicability to high-speed printing, most preferably, a cleaning device employs the method of directly contacting a cleaning blade with the photoconductor. Image forming apparatus employing this cleaning method, the electrophotographic photoconductor and the small, spherical toner particles can output high-definition images, require no lubricant application mechanism (i.e., attain downsizing), reuse toner particles, fix images at low temperatures, require less electric power for thermal fixation (i.e., save electric power), and have applicability to high-speed printing.

The cleaning unit may be a combination of a cleaning blade and another cleaning unit employing no cleaning blade.

The contact pressure and contact angle of the cleaning blade against the photoconductor may be similar to conventional cases. Also, the cleaning blade may be formed of known materials, and may have a similar shape to a known cleaning blade. Generally, increased contact pressure results in improved cleaning performance, but photoconductors or blades tend to become more worn. The contact pressure is adjusted depending on specifications of image forming apparatus.

Preferred cleaning blades are conventionally known elastic rubber blades. The elastic rubber blades preferably have a rebound resilience of 5% to 15% within a temperature range of 15° C. to 30° C. Also, the blades preferably have a rebound resilience of 10% to 20% within a temperature range of 30° C. to 45° C. Furthermore, the blades have a JIS A hardness (Hs) of 77° to 85°.

Note that two cleaning blades may be used for cleaning.

The charge-eliminating step is a step of eliminating charges by applying a charge-eliminating bias to the electrophotographic photoconductor, and can be preferably performed by the charge-eliminating unit.

The charge-eliminating unit is not particularly limited, so long as it can apply a charge-eliminating bias to the electrophotographic photoconductor, and can be appropriately selected from known charge-eliminating devices. Preferably, a charge-eliminating lamp or a similar device is used.

The recycling step is a step of recycling the toner particles removed in the above cleaning step to the developing unit, and can be preferably performed by the recycling unit.

The recycling unit is not particularly limited and may be, for example, a known conveying unit.

The controlling step is a step of controlling each of the above steps, and can be preferably performed by the controlling unit.

The controlling unit is not particularly limited, so long as it can control the operation of unit, and may be appropriately selected depending on the purpose. Examples thereof include devices such as sequencers and computers.

With reference to the drawings, next will be described the image forming apparatus and process of the present invention.

Figure 3:
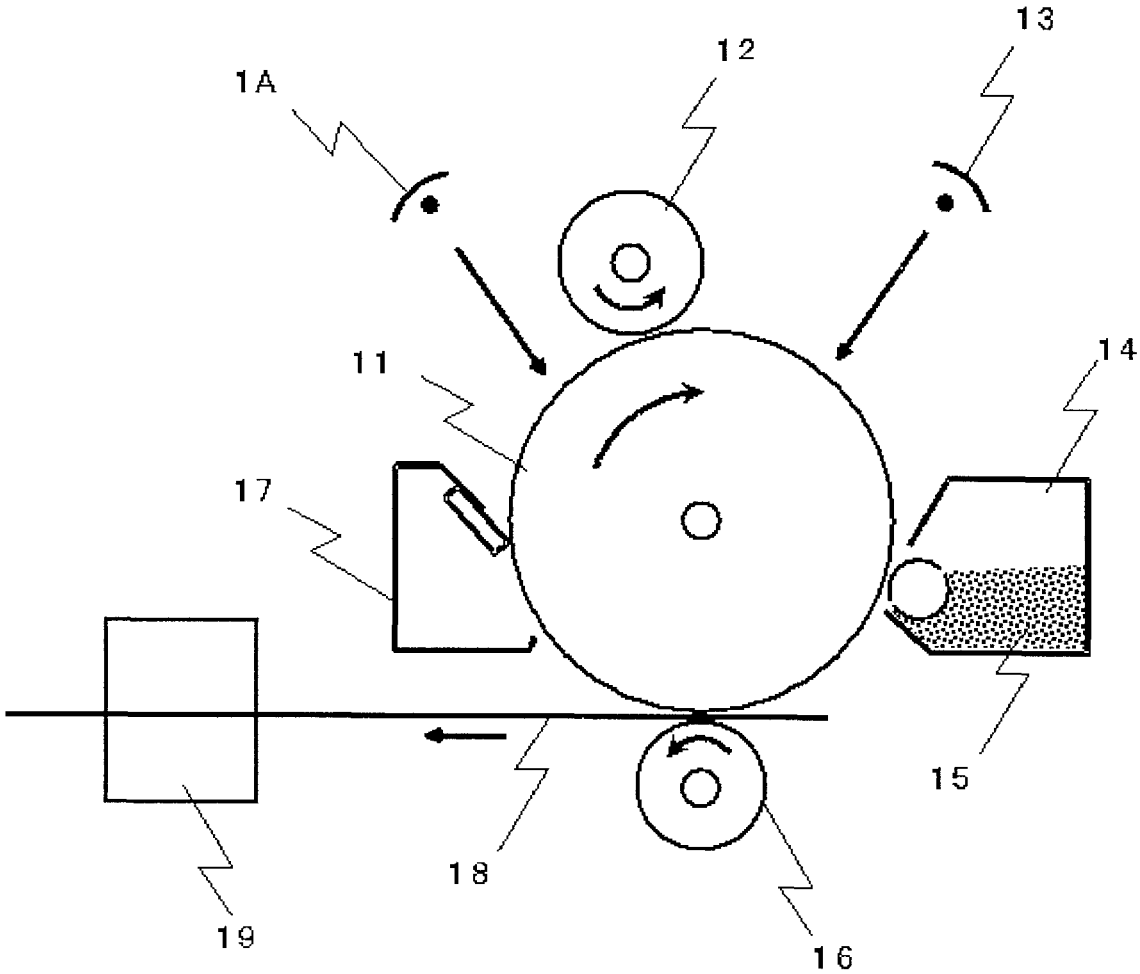
FIG. 3 is a schematic view of an image forming apparatus of the present invention.

FIG. 3 is a schematic view of an image forming apparatus of the present invention.

A photoconductor 11 shown in FIG. 3 is a multi-layer electrophotographic photoconductor having an uppermost crosslinked surface layer. The photoconductor 11 has a shape of drum. Alternatively, the photoconductor 11 may have a shape of sheet or endless belt.

A charging unit 12 may be any of known chargers such as a corotron, a scorotron, a solid state charger and a charging roller. The charging unit is preferably brought into contact with or disposed proximately to the photoconductor, from the viewpoint of reducing power consumption. Preferably, the charging unit is disposed proximately to the photoconductor such that the charging unit surface is suitably spaced from the photoconductor surface, in order to prevent the charging unit from being contaminated. Generally, a transferring unit 16 may be any of the above chargers. Separately, the transferring unit is advantageously a combination of a transfer charger and a separation charger.

A light source used in a light exposing unit 13 and a charge-eliminating unit 1A, etc. may be a usual light-emitting device such as a fluorescent lamp, a tungsten lamp, a halogen lamp, a mercury lamp, a sodium lamp, a light-emitting diode (LED), a laser diode (LD) or an electroluminescence (EL) lamp. Also, a filter may be used for applying light having a desired wavelength. The filter may be, for example, a sharp-cut filter, a band-pass filter, an infrared cut filter, a dichroic filter, an interference filter or a color conversion filter.

Toner particles 15 are transferred onto the photoconductor by developing unit 14, and then the toner particles are transferred onto a printing medium 18 such as a printing sheet or a slide sheet for OHP. After transfer, some toner particles remain on the photoconductor. Such residual toner particles are removed from the photoconductor by a cleaning unit 17. The cleaning unit may be, for example, a brush such as a rubber cleaning blade, a fur brush or a magfur brush.

An electrophotographic photoconductor is provided with positive (negative) charges, and then the electrophotographic photoconductor is subjected to imagewise light exposure, whereby a positive (negative) latent electrostatic image is formed thereon. When the positive (negative) latent electrostatic image is developed using negatively (positively) charged toner particles (charge-detecting microparticles), a positive image is obtained, whereas when the positive (negative) latent electrostatic image is developed using positively (negatively) charged toner particles, a negative image is obtained. As described above, the developing unit and the charge-eliminating unit may employ a known method.

Figure 4:
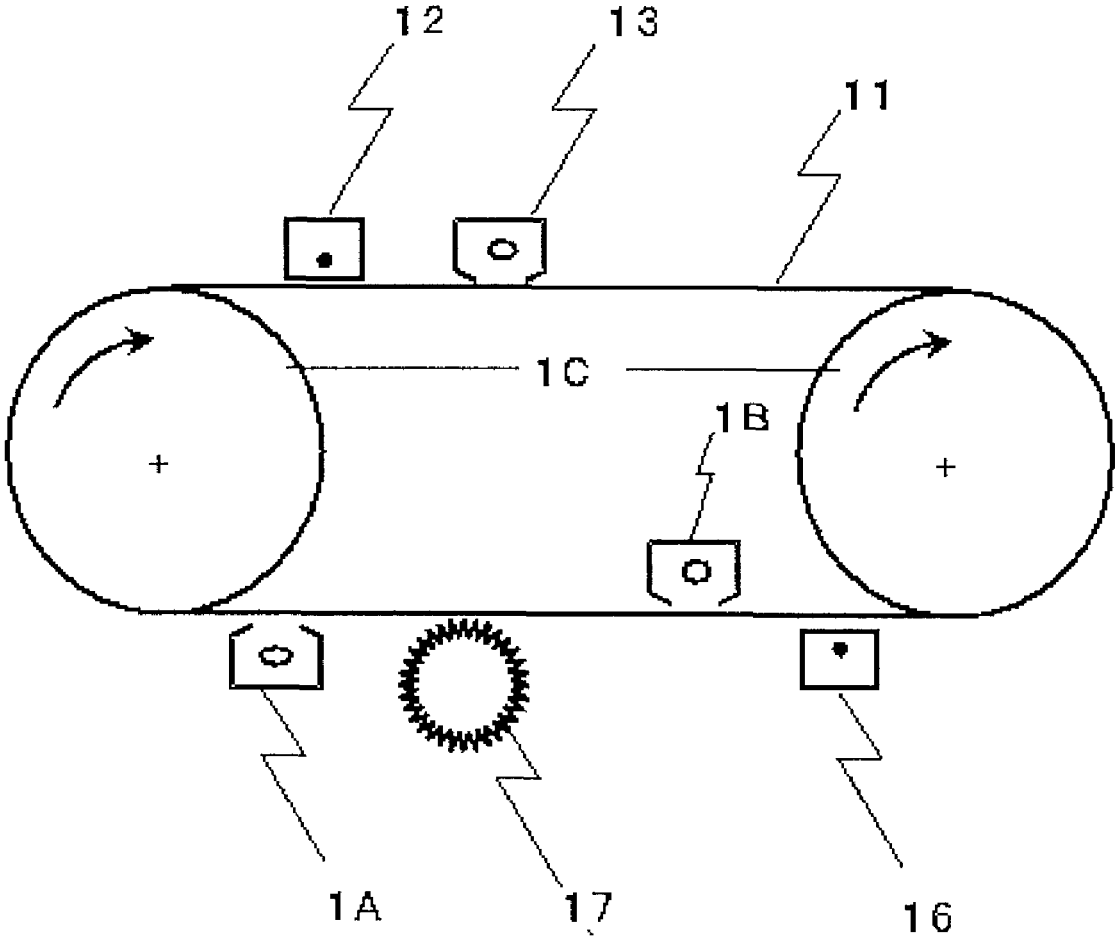
FIG. 4 is a schematic view of another image forming apparatus of the present invention.

FIG. 4 is a view of another image forming apparatus of the present invention. A photoconductor 11 shown in FIG. 4 is a multi-layer electrophotographic photoconductor having an uppermost crosslinked surface layer. The photoconductor 11 has a shape of belt. Alternatively, the photoconductor 11 may have a shape of drum, sheet or endless belt. While the photoconductor 11 is driven by a driving unit 1C, there is repeated a cycle including charging by a charging unit 12, imagewise light exposure by a light exposing unit 13, development by a developing device (not illustrated), transfer by a transferring unit 16, pre-cleaning light exposure by a pre-cleaning light exposing unit, cleaning by a cleaning brush 17, and charge elimination by a charge-eliminating unit 1A. In the apparatus shown in FIG. 4, pre-cleaning light exposure is carried out by irradiating light from the side facing a support of the photoconductor (in this case, the support has an optical transparency).

The above-described electrophotographic process is an exemplary embodiment of the present invention and other embodiments can be realized. For example, although pre-cleaning light exposure is carried out on the support side in FIG. 4, this light exposure may be carried out on the photoconductive layer side. Also, differing from the case shown in FIG. 4, imagewise light exposure and charge elimination may be carried out by irradiating light from the side facing the photoconductor support. Furthermore, although the photoconductor is irradiated with light upon imagewise light exposure, pre-cleaning light exposure and charge-eliminating light exposure in FIG. 4, additional light irradiation may be carried out by provision of known light-irradiating steps (e.g., pre-transfer light exposure and pre-light exposure before imagewise light exposure).

The above-described image forming unit may be fixed in a copier, facsimile or printer; or may be mounted therein in the form of a process cartridge.

Figure 6:
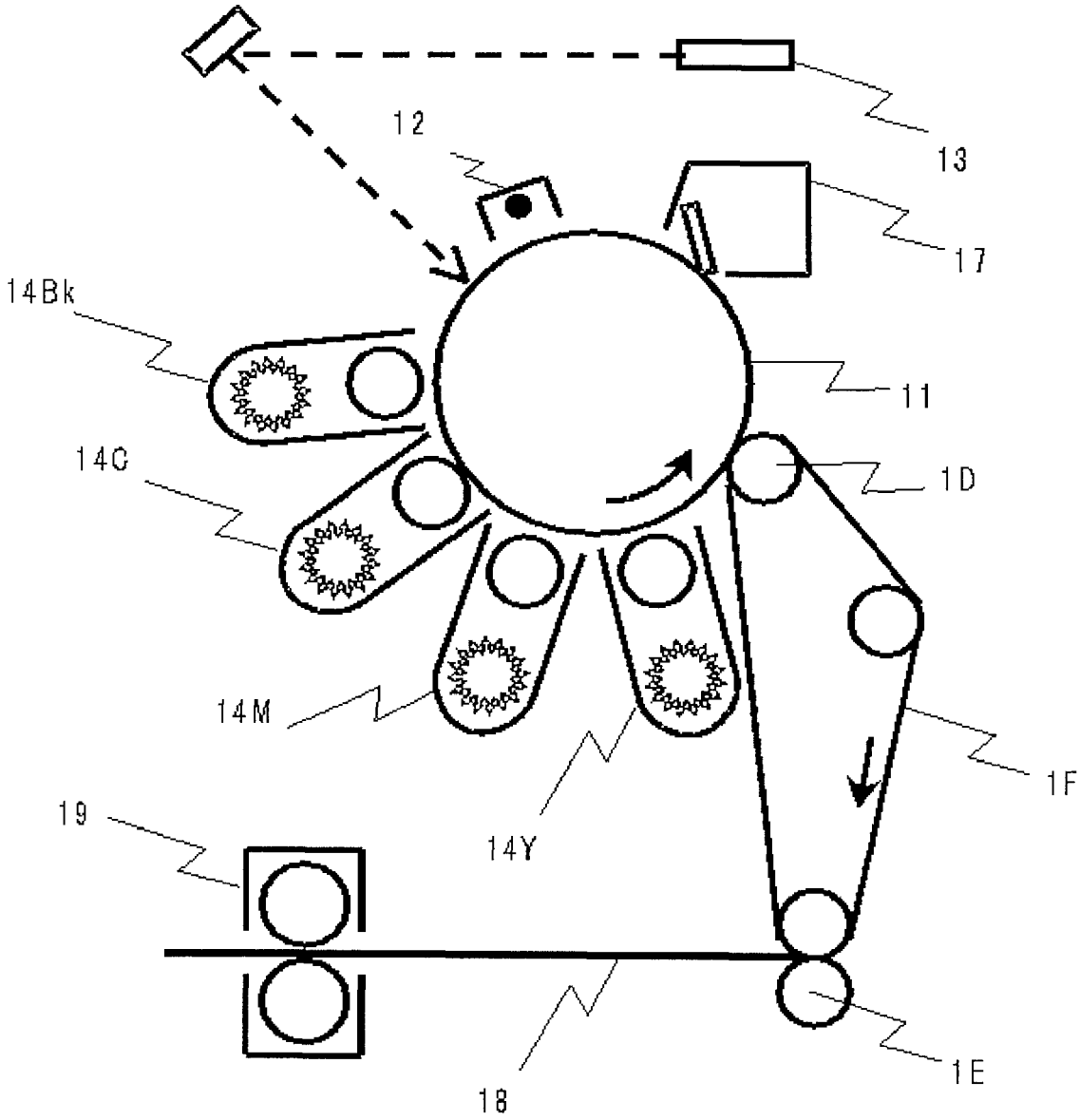
FIG. 6 is a schematic view of still another image forming apparatus of the present invention.

FIG. 6 is a view of a still another image forming apparatus of the present invention. In this image forming apparatus, around a photoconductor 11 are sequentially provided a charging unit 12, a light exposing unit 13, a developing unit 14Bk for black (Bk) toner, a developing unit 14C for cyan (C) toner, a developing unit 14M for magenta (M) toner, developing unit 14Y for yellow (Y) toner, an intermediate transfer belt 1F (serving as an intermediate transfer member), and a cleaning unit 17. In FIG. 6, the reference characters Bk, C, M and Y-correspond to colors of toner, and are omitted in some cases. The photoconductor 11 is a multi-layer electrophotographic photoconductor having a crosslinked surface layer. The developing units 14Bk, 14C, 14M and 14Y can be independently controlled; i.e., the developing unit for color toner participating in image formation can only be driven.

A toner image formed on the photoconductor 11 is transferred onto an intermediate transfer belt 1F by a first transferring unit 1D which is provided in a loop of the belt 1F. The first transferring unit 1D can come into contact with or be separated from the photoconductor 11 and, only during transfer, the intermediate transfer belt 1F comes into contact with the photoconductor 11. After image formation using each color toner, the superposed toner image formed on the intermediate transfer belt 1F is transferred onto a printing medium 18 by a second transferring unit 1E, followed by fixing with a fixing unit 19. The second transferring unit 1E can also come into contact with or be separated from the intermediate transfer belt 1F and, only during transfer, the second transferring unit 1E comes into contact with the intermediate transfer belt 1F.

In image forming apparatus employing a transfer drum, a toner image of each color is successively transferred onto a recording medium electrostatically adsorbed on the transfer drum, which imposes limitation on the type of the recording medium (i.e., not applicable to cardboard); whereas in image forming apparatus employing an intermediate transfer member as shown in FIG. 6, a toner image of each color is superposed on the intermediate transfer member 1F, which imposes no limitation on the type of the recording medium. In addition to the image forming apparatus shown in FIG. 6, such an intermediate transfer method can be applied to image forming apparatus shown in FIGS. 3, 4, 6, 7 and 8.

Figure 7:
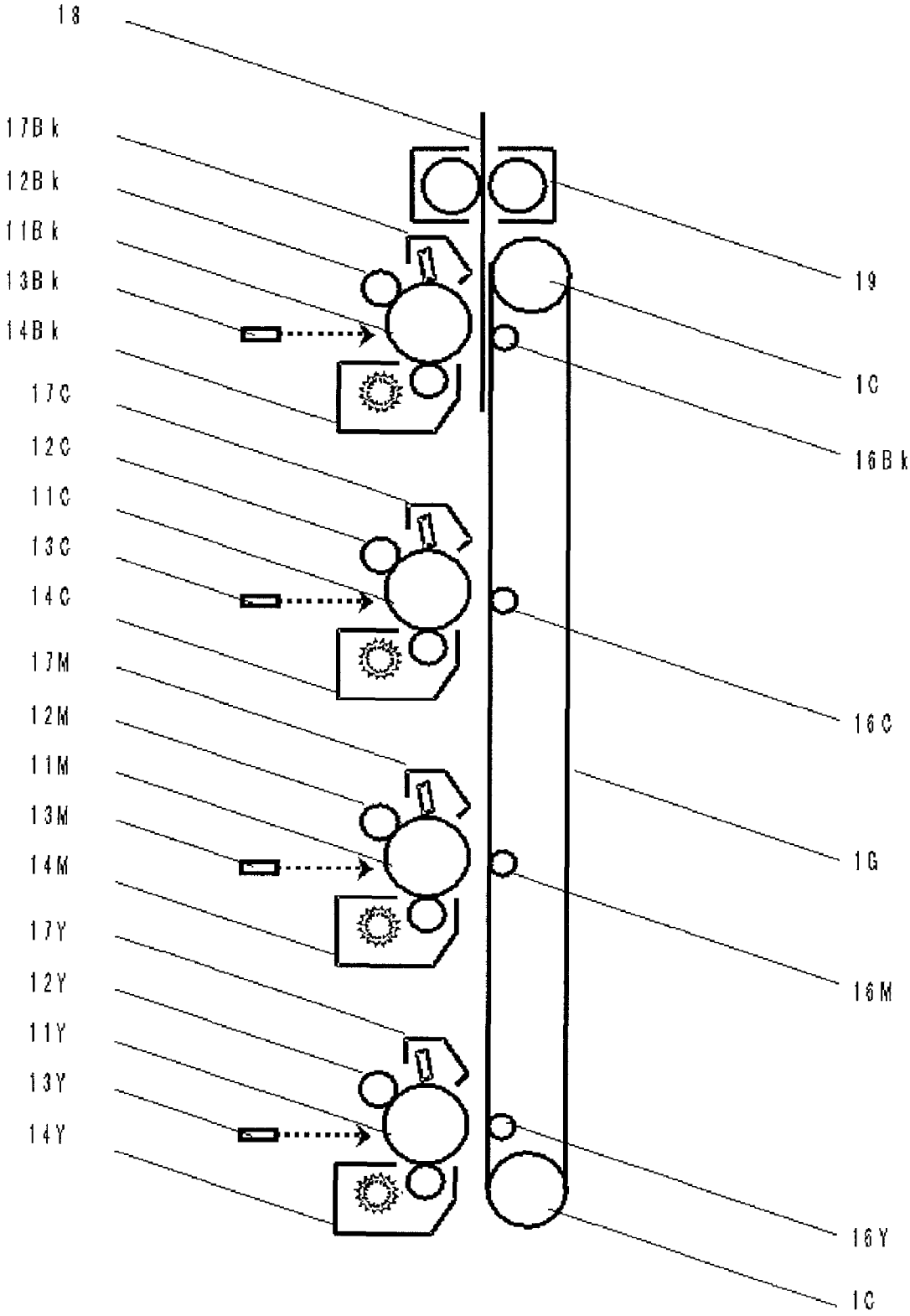
FIG. 7 is a schematic view of a tandem image forming apparatus of the present invention.
Figure 8:
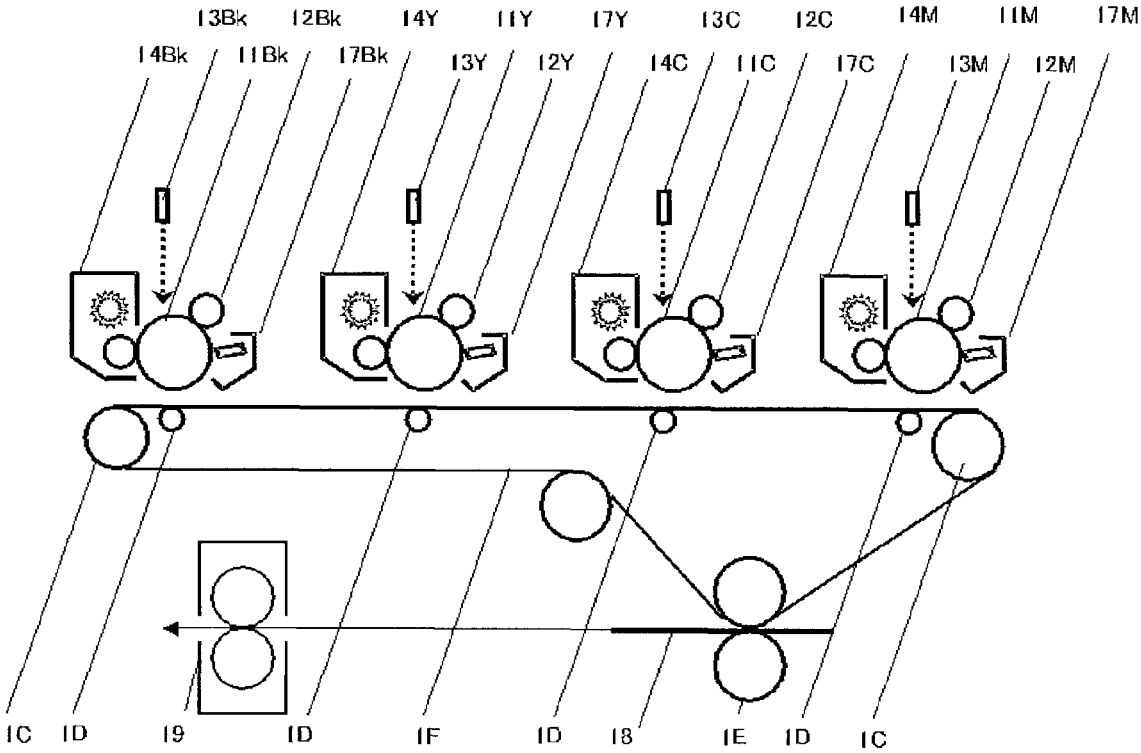
FIG. 8 is a schematic view of another tandem image forming apparatus of the present invention.

FIGS. 7 and 8 show other image forming apparatus of the present invention. In these image forming apparatus, yellow (Y) toner, magenta (M) toner, cyan (C) toner, black (Bk) toner are used, and image forming units for these color toners are provided. Further, photoconductors 11Y, 11M, 11C and 11Bk for the toners are linearly provided. The photoconductor 11 used in the image forming apparatus is a multi-layer electrophotographic photoconductor having an uppermost crosslinked surface layer. Around each of the photoconductors 11Y, 11M, 11C and 11Bk are provided a charging unit 12, a light exposing unit 13, a developing unit 14, a cleaning unit 17, etc. Also, a conveying transfer belt 1G is supported by drive units 1C. The conveying transfer belt 1G is a recording medium-holding member which comes into contact with or is separated from the photoconductor (11Y, 11M, 11C and 11Bk) surface portions where transfer of toner images is to be performed. Furthermore, transferring units 16 are provided correspondingly to the photoconductor (11Y, 11M, 11C and 11Bk) surfaces such that the conveying transfer belt 1G is sandwiched between the units and the surfaces.

The tandem image forming apparatus shown in FIGS. 7 and 8 have photoconductors 11Y, 11M, 11C and 11Bk for color toners, and a toner image of each color is transferred onto the recording medium 18 held on the conveying transfer belt 1G. Thus, such tandem image forming apparatus can output full-color images at a remarkably higher speed than a full-color image forming apparatus having a single photoconductor.

(Process Cartridge)

A process cartridge of the present invention includes the present electrophotographic photoconductor, a developing unit, a cleaning unit and, if necessary, includes other units, wherein the developing unit forms a visible image by developing, with toner, a latent electrostatic image formed on the electrophotographic photoconductor, and the cleaning unit removes residual toner particles on a surface of the electrophotographic photoconductor.

The developing unit includes a developer container for toner (developer), and carriers for carrying and transferring toner (developer) held in the container. The developing unit may further include a member for adjusting the thickness of toner particles to be carried.

The present process cartridge may be detachably mounted in various image forming apparatus, preferably in the present image forming apparatus.

Figure 5:
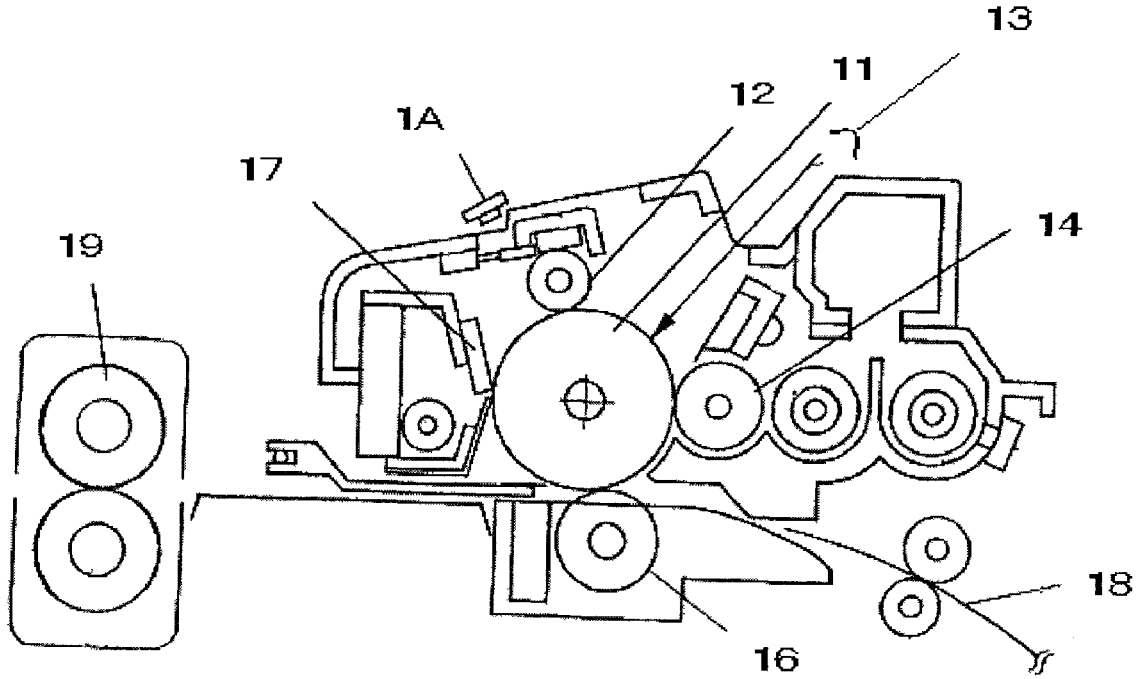
FIG. 5 is a schematic view of a process cartridge of the present invention.

As shown in FIG. 5, the process cartridge includes a photoconductor 11, a charging unit 12, a light exposing unit (not illustrated), a developing unit 14, a cleaning unit 17, a transferring unit 16, a charge-eliminating unit 1A and, if necessary, includes other units. Note that reference numeral 13 refers to light applied from the light exposing unit.

Next will be described an image forming process by the process cartridge shown in FIG. 5. While rotated, the photoconductor 11 is charged by the charging unit 12 and then imagewise exposed to light 13 from the light exposing unit to have a latent electrostatic image corresponding to the light. The latent electrostatic image is developed with toner by the developing unit 14. The developed toner image is transferred onto a recording medium 18 by the transferring unit 16, and then the recording medium 18 is output. The photoconductor surface after transfer of the toner image is cleaned by the cleaning unit 17 and then charge-eliminated by the charge-eliminating unit 1A. The above-described process is repeated.

The image forming apparatus and process cartridge of the present invention can provide high-quality color images, since they contain the present electrophotographic photoconductor which has remarkably excellent wear resistance, which can provide high-quality color images, and which can prevent a cleaning blade from chipping.

The present invention can solve the above-described existing problems, and can provide an electrophotographic photoconductor which has remarkably excellent wear resistance, which can provide high-quality color images, and which can prevent a cleaning blade from chipping; and a process cartridge and an image forming apparatus which contain the electrophotographic photoconductor.

EXAMPLES

The present invention will next be described by way of examples, which should not be construed as limiting the present invention thereto.

Example 1

Fabrication of Electrophotographic Photoconductor

An undercoat layer-coating liquid having the following composition was coated on an aluminum drum (thickness: 0.8 mm, length: 340 mm and outer diameter: 30 mm), followed by drying, to thereby form an undercoat layer with a thickness of 3.5 μm. Thereafter, a charge generation layer-coating liquid having the following composition was coated on the undercoat layer, followed by drying, to thereby form a charge generation layer with a thickness of 0.2 μm. Thereafter, a charge transport layer-coating liquid having the following composition was coated on the charge generation layer, followed by drying, to thereby form a charge transport layer with a thickness of 18 μm.

Subsequently, a crosslinked surface layer-coating liquid having the following composition was sprayed over the charge transport layer for coating. While rotated, the thus-coated drum was subjected to UV curing at a position 120 mm distant from a UV curing lamp (rotating speed of drum: 25 rpm; and UV irradiation dose: 600 mW/cm$^2$ (measured with an accumulated UV meter UIT-150 (product of USHIO INC.))). During UV curing, a rod-like metal block was placed in the aluminum drum. UV curing was performed by repeating a cycle of irradiation (30 sec) and intermittence (120 sec) until the total irradiation time reached 7 min. After UV curing, the aluminum drum was dried with heating at 130° C. for 30 min to form a crosslinked surface layer with a thickness of 3 μm. Through the above procedure, an electrophotographic photoconductor of Example 1 was fabricated.

[Undercoat Layer-Coating Liquid]

Alkyd resin solution (BECKOLITE M6401-50, product of Dainippon Ink and Chemicals Inc.): 12 parts by mass Melamine resin solution (SUPER BECKAMINE G-821-60, product of Dainippon Ink and Chemicals Inc.): 8 parts by mass Titanium oxide (CR-EL, product of ISHIHARA SANGYO KAISHA LTD.): 40 parts by mass Methyl ethyl ketone: 200 parts by mass

[Charge Generation Layer-Coating Liquid]

Bisazo pigment having the following structure (product of Ricoh Company Ltd.): 6 parts by mass

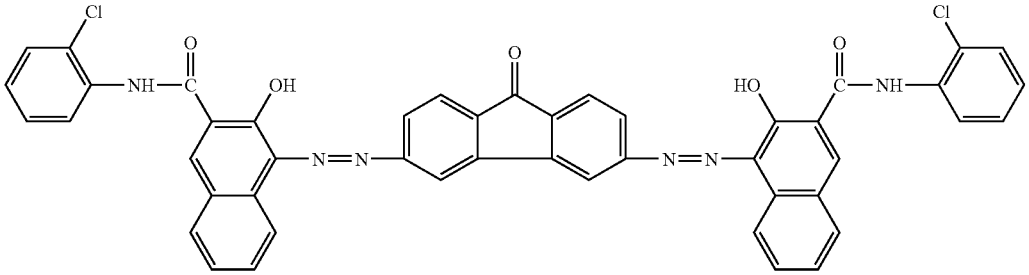

Polyvinyl butyral (XYHL, product of UCC): 1 part by mass

Cyclohexanone: 200 parts by mass

Methyl ethyl ketone: 80 parts by mass

[Charge Transport Layer-Coating Liquid]

Z-type polycarbonate (Panlite TS-2050, product of TEIJIN CHEMICALS LTD.): 10 parts by mass Low-molecular-weight charge transport material having the following structure: 10 parts by mass

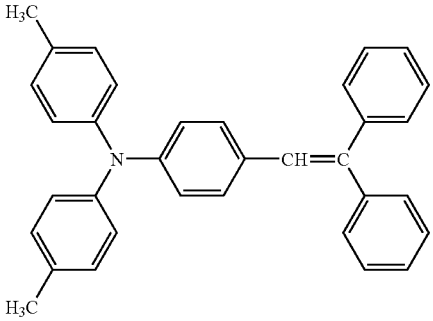

Tetrahydrofuran: 100 parts by mass

Tetrahydrofuran solution of silicone oil (1% by mass) (KF50-100CS, product of Shin-Etsu Chemical Co., Ltd.): 1 part by mass

[Crosslinked Surface Layer-Coating Liquid]

Curable charge transport material having the following structure: 40 parts by mass

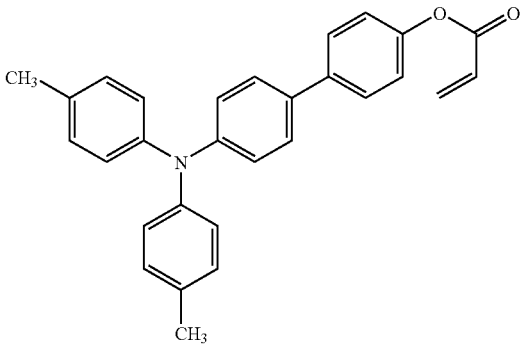

Trimethylolpropane triacrylate (KAYARAD TMPTA, product of NIPPON KAYAKU CO., LTD.): 25 parts by mass Caprolactone-modified dipentaerythritol hexaacrylate (KAYARAD DPCA-120, product of NIPPON KAYAKU CO., LTD.): 25 parts by mass Mixture of acryl group-containing polyester-modified polydimethylsiloxane (reactive silicone compound) and propoxy modified-2-neopentylglycol diacrylate (BYK-UV3570, product of BYK Chemie): 0.1 parts by mass 1-Hydroxycyclohexyl phenyl ketone (IRGACURE 184, product of Chiba Specialty Chemicals Corp.): 5 parts by mass Organosilica sol (NSC3456, product of Nippon Fine Chemical): 20 parts by mass Radical-polymerizable isocyanate (Karenz BEI (1,1-bis (acryloyloxymethyl)ethylisocyanate), product of SHOWA DENKO K.K.): 2 parts by mass Tetrahydrofuran: 400 parts by mass

Comparative Example 1

Fabrication of Electrophotographic Photoconductor

There was prepared a crosslinked surface layer-coating liquid that was the same as the crosslinked surface layer-coating liquid used in Example 1, except that no organosilica sol was used. The procedure of Example 1 was repeated, except that the thus-prepared crosslinked surface layer-coating liquid was used, to thereby fabricate an electrophotographic photoconductor.

Comparative Example 2

Fabrication of Electrophotographic Photoconductor

There was prepared a crosslinked surface layer-coating liquid that was the same as the crosslinked surface layer-coating liquid used in Example 1, except that no radical-polymerizable isocyanate was used. The procedure of Example 1 was repeated, except that the thus-prepared crosslinked surface layer-coating liquid was used, to thereby fabricate an electrophotographic photoconductor.

Example 2

Fabrication Electrophotographic Photoconductor

There was prepared a crosslinked surface layer-coating liquid that was the same as the crosslinked surface layer-coating liquid used in Example 1, except that the radical-polymerizable isocyanate (Karenz BEI, product of SHOWA DENKO K.K.) was changed to a radical-polymerizable isocyanate (Karenz MOI (2-methacryloyloxyethyl isocyanate), product of SHOWA DENKO K.K.). The procedure of Example 1 was repeated, except that the thus-prepared crosslinked surface layer-coating liquid was used, to thereby fabricate an electrophotographic photoconductor.

Example 3

Fabrication of Electrophotographic Photoconductor

There was prepared a crosslinked surface layer-coating liquid that was the same as the crosslinked surface layer-coating liquid used in Example 1, except that the radical-polymerizable isocyanate (Karenz BEI, product of SHOWA DENKO K.K.) was changed to a radical-polymerizable isocyanate (Karenz AOI (2-acryloyloxyethyl isocyanate), product of SHOWA DENKO K.K.). The procedure of Example 1 was repeated, except that the thus-prepared crosslinked surface layer-coating liquid was used, to thereby fabricate an electrophotographic photoconductor.

Comparative Example 3

Fabrication of Electrophotographic Photoconductor

There was prepared a crosslinked surface layer-coating liquid that was the same as the crosslinked surface layer-coating liquid used in Example 1, except that no curable charge transport material was used. The procedure of Example 1 was repeated, except that the thus-prepared crosslinked surface layer-coating liquid was used, to thereby fabricate an electrophotographic photoconductor.

An image forming apparatus using the thus-fabricated photoconductor was caused to print out images based on image signals. As a result, the printed images had low density and thus, this photoconductor was not further evaluated.

Comparative Example 4

Fabrication of Electrophotographic Photoconductor

There was prepared a crosslinked surface layer-coating liquid that was the same as the crosslinked surface layer-coating liquid used in Example 2, except that no curable charge transport material was used. The procedure of Example 2 was repeated, except that the thus-prepared crosslinked surface layer-coating liquid was used, to thereby fabricate an electrophotographic photoconductor.

An image forming apparatus using the thus-fabricated photoconductor was caused to print out images based on image signals. As a result, the printed images had low density and thus, this photoconductor was not further evaluated.

Comparative Example 5

Fabrication of Electrophotographic Photoconductor

There was prepared a crosslinked surface layer-coating liquid that was the same as the crosslinked surface layer-coating liquid used in Example 3, except that no curable charge transport material was used. The procedure of Example 3 was repeated, except that the thus-prepared crosslinked surface layer-coating liquid was used, to thereby fabricate an electrophotographic photoconductor.

An image forming apparatus using the thus-fabricated photoconductor was caused to print out images based on image signals. As a result, the printed images had low density and thus, this photoconductor was not further evaluated.

Each of the electrophotographic photoconductors of Examples 1 to 3 and Comparative Examples 1 and 2 was evaluated for its surface hardness, image quality, and the amount of toner particles run through the gap between itself and a cleaning blade (run-through degree). The results are shown in Table 1.

<Measurement of Surface Hardness>

The electrophotographic photoconductor was measured for its Martens hardness (surface hardness) with a micro surface hardness tester (H-100, product of Fisher Co.). The hardness was measured at five points in the vicinity of the central portion in the longitudinal direction of the electrophotographic photoconductor.

<Measurement of Run-Through Degree>

A photoconductor set for measuring run-through degree was provided. The photoconductor set was the same as an imagio Neo C455 photoconductor set (product of Ricoh Company Ltd.), except that a cleaning brush, a cleaner for a charging roller, and a zinc stearate rod were removed. This photoconductor set was mounted to a black toner-developing station of an image forming apparatus. Among biases applied to a charging roller of imagio Neo C455 (product of Ricoh Company Ltd.), a DC bias was adjusted so that the photoconductor had a charge potential of −700V. Subsequently, the light irradiation dose for writing was adjusted so that the electric potential at light exposed areas was −250V. In this state, solid patterns were written while varying developing biases. Before transfer, toner adsorbed on the photoconductor was peeled off using a piece of transparent adhesive tape (product of NITTO DENKO CORPORATION, Printac C). The tape was measured for its image density with a reflectance spectrodensitometer (product of Canon i-tech, Inc., X-RITE939), and the developing bias was changed so that the image density was 1.0.

Subsequently, a catcher for toner particles run through the gap (felt (thickness: 1 mm; 8 mm×310 mm), product of TSUCHIYA CO., LTD.) was attached to the top end of the opening of a developing unit via a piece of linear sponge tape (thickness: 2 mm) (product of Sumitomo 3M Ltd., Scotch Tape 4016). This developing unit was provided in the image forming apparatus.

After the above-fabricated photoconductor drums had been cleaned, each drum was mounted to the image forming apparatus, to which a new cleaning blade (genuine product for imagio Neo C455 (product of Ricoh Company Ltd.)) had been mounted. The image forming apparatus was caused to continuously output, at 23° C. and 55% RH, 50 sheets of copy paper (My Paper A4, product of NBS Ricoh Company Ltd.) having an A4 size test pattern with an image density of 5%. Note that genuine polymerization toner was used.

The image formed on the catcher, which had been recovered after printing, was converted to digital data using an image scanner (product of SEIKO EPSON CORPORATION, ES-8500) under the following conditions: zoom: 100%, color correction (by a color driver): 1.0, output: 800 dpi, picture: 800 dpi, and unsharp mask: middle and 8 bit gray.

The thus-obtained image data were analyzed for their image densities and image area ratios with Image Pro Plus Ver3.0 (product of MediaCyabernetics) at five divisions between upper limit (210) and lower limit (310) on Pseudo-Color command. The sum of the values of image density and image area ratio was employed as run-through degree.

<Evaluation of Image Quality>

Each of the above-fabricated electrophotographic photoconductor of Examples 1 to 3 and Comparative Examples 1 and 2 was adjusted for actual use, and then was mounted in a black-toner developing station of a tandem image forming apparatus (imagio Neo C455, product of Ricoh Company Ltd.). The image forming apparatus was caused to output 1,000,000 sheets of copy paper (My Paper A4, product of NBS Ricoh Company Ltd.) having a halftone pattern (4×4 dots present in an 8×8 matrix) with an image density of 600 dpi×600 dpi by repeating a cycle of five sheets continuous printing and intermittence at 24° C. and 54% RH. Note that the photoconductor sets used in this printing contained a zinc stearate rod.

In this tandem image forming apparatus, a loading spring provided in the cleaning blade was changed to an SUS spring with a spring load of 0.40 N/mm, a free length of 14 mm, and an inner diameter of 5 mm; and a genuine photoconductor unit and genuine toner/developer for Imagio Neo C455 were used.

The AC component of the voltage applied to the charging roller was set to a peak-to-peak voltage of 1.5 kV and a frequency of 0.9 kHz. A bias for the DC component thereof was set so that the initial charge potential of the photoconductor stands at −700V, which was unchanged until completion of the test. Also, a developing bias was set to −500V. This image forming apparatus contained no charge-eliminating unit. A genuine cleaning unit was used in this test, and the cleaning unit was replaced with a new one every 50,000 printings. After completion of the test, a color test chart was printed on a sheet of A3 size PPC paper (TYPE-6200).

TABLE 1

| | Martens hardness ($N/mm^2$) | Run-through degree | Image evaluation |
|---|---|---|---|
| Ex. 1 | 170 ± 1 | 75 | Normal |
| Comp. Ex. 1 | 160 ± 7 | 133 | At 1,000 printings, generally oval filming was generated on the photoconductor, causing fine, streaky image noise |
| Comp. Ex. 2 | 155 ± 22 | 88 | At 100,000 printings, streaky image noise was caused |
| Ex. 2 | 175 ± 1 | 73 | Normal |
| Ex. 3 | 173 ± 2 | 78 | Normal |

From the data shown in Table 1, the electrophotographic photoconductors of Examples 1 and 3 have a sufficient mechanical strength to be applicable to printing of 1,000,000 sheets, are prevented from generating generally oval filming thereon, and exhibit a sharp surface hardness distribution, since they include a crosslinked surface layer formed of a crosslinked surface layer composition containing trimethylolpropane triacrylate, organosilica sol and a radical-polymerizable isocyanate compound. Thus, the cleaning blade is uniformly worn and does not chip. Also, the surface layer containing a charge transport material exhibits stable photo-induced discharge characteristics. Thus, the electrophotographic photoconductor of the present invention can provide high-quality printed images with a satisfactory image density over a long period of time.

The electrophotographic photoconductor of the present invention has remarkably excellent wear resistance, can provide high-quality color images, and can prevent a cleaning blade from chipping. Thus, the present electrophotographic photoconductor can be widely applied, for example, to process cartridges, electrophotographic image forming apparatus, laser beam printers, CRT printers, LED printers, liquid crystal printers and laser engraving machines.

What is claimed is:

1. An electrophotographic photoconductor comprising:

an uppermost crosslinked surface layer including a cured product of a crosslinked surface layer composition containing a tri- or more functional radical-polymerizable monomer having no charge transportable structure, organosilica sol, an isocyanate group-containing radical-polymerizable monomer, and a curable charge transport material.

2. The electrophotographic photoconductor according to claim 1, wherein the tri- or more functional radical-polymerizable monomer having no charge transportable structure includes trimethylolpropane triacrylate.

3. The electrophotographic photoconductor according to claim 1, wherein the isocyanate group-containing radical-polymerizable monomer is any one of 2-methacryloyloxyethyl isocyanate, 2-acryloyloxyethyl isocyanate and 1,1-bis(acryloyloxymethyl)ethylisocyanate.

4. The electrophotographic photoconductor according to claim 1, wherein the curable charge transport material content of the crosslinked surface layer composition is 5% by mass to 60% by mass on a solid basis, and the curable charge transport material is a compound represented by the following general formula (1):

General Formula (1)

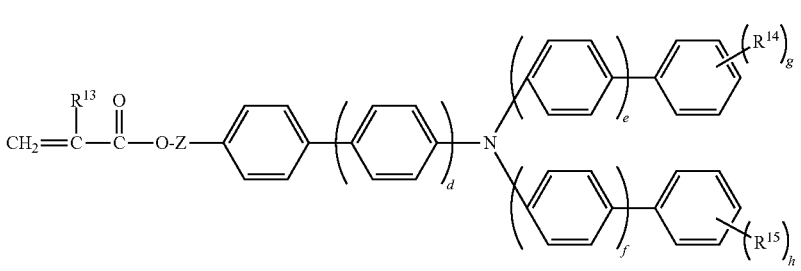

wherein $R^{13}$ represents a hydrogen atom or a methyl group; $R^{14}$ and $R^{15}$, which may be identical or different, each represent an alkyl group having 1 to 6 carbon atoms; g or h is an integer of 0 to 3; d, e or f is an integer of 0 or 1; and Z represents a single bond, a methylene group, an ethylene group or any one of groups represented by the following structural formulas:

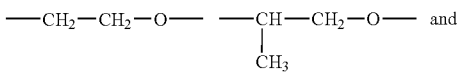

-continued

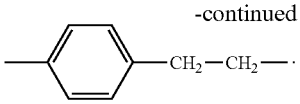

5. The electrophotographic photoconductor according to claim 1, wherein the crosslinked surface layer composition contains a reactive silicone compound having a dimethylsiloxane structure as a repeating unit and having a radical-polymerizable functional group.

6. The electrophotographic photoconductor according to claim 1, wherein the electrophotographic photoconductor includes, in sequence, a support, a charge generation layer, a charge transport layer and a crosslinked surface layer.

7. A process cartridge comprising:

an electrophotographic photoconductor, a developing unit configured to form a visible image by developing with toner a latent electrostatic image formed on the electrophotographic photoconductor, and a cleaning unit configured to remove residual toner particles on a surface of the electrophotographic photoconductor, wherein the electrophotographic photoconductor includes an uppermost crosslinked surface layer including a cured product of a crosslinked surface layer composition containing a tri- or more functional radical-polymerizable monomer having no charge transportable structure, organosilica sol, an isocyanate group-containing radical-polymerizable monomer, and a curable charge transport material.

8. An image forming apparatus comprising:

an electrophotographic photoconductor, a latent electrostatic image forming unit configured to form a latent electrostatic image on the electrophotographic photoconductor, a developing unit configured to form a visible image by developing the latent electrostatic image with toner, a transferring unit configured to transfer the visible image onto a recording medium, and a cleaning unit configured to remove residual toner particles on a surface of the electrophotographic photoconductor, wherein the electrophotographic photoconductor includes an uppermost crosslinked surface layer including a cured product of a crosslinked surface layer composition containing a tri- or more functional radical-polymerizable monomer having no charge transportable structure, organosilica sol, an isocyanate group-containing radical-polymerizable monomer, and a curable charge transport material.

9. The image forming apparatus according to claim 8, wherein the image forming apparatus is a tandem image forming apparatus including image forming components including the electrophotographic photoconductor, a charging unit, a developing unit, a transferring unit and a cleaning unit, wherein polymerization toner is used in the developing unit.

* * * * *